US011430391B2

(12) United States Patent
Kwak et al.

(10) Patent No.: US 11,430,391 B2
(45) Date of Patent: Aug. 30, 2022

(54) VIRTUAL REALITY (VR) GATE DRIVER CHANGING RESOLUTION OF DISPLAY PANEL BASED ON CHANGING EYE FOCUS POSITION

(71) Applicant: LG Display Co., Ltd., Seoul (KR)

(72) Inventors: Bongchoon Kwak, Paju-si (KR); Sunkyung Shin, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/352,794

(22) Filed: Jun. 21, 2021

(65) Prior Publication Data

US 2021/0398491 A1 Dec. 23, 2021

(30) Foreign Application Priority Data

Jun. 23, 2020 (KR) ..... 10-2020-0076553

(51) Int. Cl.
*G09G 3/3266* (2016.01)
*G09G 3/3275* (2016.01)
*G09G 3/36* (2006.01)

(52) U.S. Cl.
CPC ..... *G09G 3/3266* (2013.01); *G09G 3/3275* (2013.01); *G09G 3/3677* (2013.01);
(Continued)

(58) Field of Classification Search
CPC ..... G09G 3/30; G09G 3/32; G09G 3/3208; G09G 3/3216; G09G 3/3225;
(Continued)

(56) References Cited

U.S. PATENT DOCUMENTS 10,410,313 B2 9/2019 Saleh et al.
10,504,442 B2 12/2019 Too
(Continued)

FOREIGN PATENT DOCUMENTS

JP 2003-162266 A 6/2003
JP 2008-020675 A 1/2008
(Continued)

OTHER PUBLICATIONS

Office Action dated Jun. 17, 2022, issued in corresponding Japanese Patent Application No. 2021-103725, 9 pages including translation.

*Primary Examiner* — Alexander Eisen
*Assistant Examiner* — Nelson Lam
(74) *Attorney, Agent, or Firm* — Morgan, Lewis & Bockius LLP

(57) ABSTRACT

A gate driver, a data driver, and a display apparatus including the gate driver and the data driver, may enable a resolution of each region of a display panel to be changed. The gate driver may include a gate resolution control signal output device outputting gate resolution control signals; a gate pulse generating device generating gate pulses to be output to gate lines; and a gate line selection device selecting gate lines, to which the gate pulses output from the gate pulse generating device are to be transferred, on the basis of the gate resolution control signals. The gate pulse generating device includes gate stages generating the gate pulses. The gate line selection device includes gate serial switches; and gate parallel switches. The gate serial switches respectively connect the gate stages to the gate lines, and each of the gate parallel switches connects two adjacent gate lines.

17 Claims, 12 Drawing Sheets

(52) U.S. Cl.
CPC ... *G09G 3/3688* (2013.01); *G09G 2310/0286* (2013.01); *G09G 2340/0407* (2013.01); *G09G 2354/00* (2013.01)

(58) Field of Classification Search
CPC .... G09G 3/3233; G09G 3/3241; G09G 3/325; G09G 3/3258; G09G 3/3266; G09G 3/3275; G09G 3/3283; G09G 3/36; G09G 3/3611; G09G 3/3622; G09G 3/3625; G09G 3/3674; G09G 3/3677; G09G 3/3681; G09G 2340/0407; G09G 2340/0414; G09G 2340/0421
USPC ..... 345/7–9, 76–83, 87–104
See application file for complete search history.

(56) References Cited

U.S. PATENT DOCUMENTS

| | | | | |
|---|---|---|---|---|
| 10,878,527 | B2 | 12/2020 | Selvik et al. | |
| 2002/0113755 | A1* | 8/2002 | Lee | G02B 7/12 345/7 |
| 2004/0189572 | A1* | 9/2004 | Nose | G09G 3/3677 345/92 |
| 2004/0189681 | A1* | 9/2004 | Itakura | G09G 3/3648 345/698 |
| 2010/0053031 | A1* | 3/2010 | Koike | G02B 27/017 345/8 |
| 2015/0054716 | A1* | 2/2015 | Hirabayashi | G02B 27/01 345/8 |
| 2016/0267713 | A1* | 9/2016 | Patel | G06T 19/20 |
| 2018/0262758 | A1 | 9/2018 | El-Ghoroury et al. | |
| 2019/0005884 | A1* | 1/2019 | Yoo | G06F 3/011 |
| 2019/0156759 | A1* | 5/2019 | Wang | G09G 3/3258 |

FOREIGN PATENT DOCUMENTS

| | | | |
|---|---|---|---|
| JP | 2008-224798 | A | 9/2008 |
| JP | 2009-258733 | A | 11/2009 |
| JP | 2017-503218 | A | 1/2017 |
| JP | 2017-040881 | A | 2/2017 |
| KR | 10-2019-0003334 | A | 1/2019 |
| KR | 10-2019-0031496 | A | 3/2019 |
| KR | 10-2019-0126840 | A | 11/2019 |
| KR | 10-2019-0129013 | A | 11/2019 |

* cited by examiner (a)

| | 1 | 2 | 3 | 4 | 5 | 6 | 7 | 8 | 9 | 10 | 11 | 12 |
|---|---|---|---|---|---|---|---|---|---|---|---|---|
| IDS | off | on | on | on | off | on | off | on | off | off | off | off |
| PD | off | on | on | on | off | on | off | on | off | off | off | off |

(b)

| | OGS | IGS |
|---|---|---|
| 1 | on | off |
| 2 | off | on |
| 3 | off | on |
| 4 | off | on |
| 5 | on | off |
| 6 | off | on |
| 7 | on | off |
| 8 | off | on |
| 9 | on | off |
| 10 | on | off |
| 11 | on | off |
| 12 | on | off |

(a)

| | 1 | 2 | 3 | 4 | 5 | 6 | 7 | 8 | 9 | 10 | 11 | 12 |
|---|---|---|---|---|---|---|---|---|---|---|---|---|
| ODS | on | off | off | off | on | off | on | off | on | on | on | on |
| IDS | off | on | on | on | off | on | off | on | off | off | off | off |

VIRTUAL REALITY (VR) GATE DRIVER CHANGING RESOLUTION OF DISPLAY PANEL BASED ON CHANGING EYE FOCUS POSITION

CROSS-REFERENCE TO RELATED APPLICATIONS

This application claims the benefit of the Korean Patent Application No. 10-2020-0076553 filed on Jun. 23, 2020, which is hereby incorporated by reference as if fully set forth herein.

BACKGROUND

Technical Field

The present disclosure relates to a display apparatus, and more particularly, to a display apparatus applied to a virtual reality (VR) device.

Discussion of the Related Art

VR devices are devices for enabling a user to feel an environment similar to a real environment.

The VR devices include a display apparatus. Examples of display apparatuses include liquid crystal display (LCD) apparatuses and light emitting display apparatuses, and the display apparatuses include a display panel.

In a related art display panel applied to the VR devices, a resolution of the display panel is fixed for each region.

However, a focus position of eyes of a user are not fixed, and thus, as positions of eyes of a user are changed, a resolution of each region of the display panel should be changed.

SUMMARY

Accordingly, embodiments of the present disclosure are directed to a display apparatus that substantially obviates one or more problems due to limitations and disadvantages of the related art.

An aspect of the present disclosure is to provide a gate driver, a data driver, and a display apparatus including the gate driver and the data driver, which enable a resolution of each region of a display panel to be changed.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described herein, a gate driver comprises a gate resolution control signal output device outputting gate resolution control signals, a gate pulse generating device generating gate pulses which are to be output to a plurality of gate lines, and a gate line selection device selecting gate lines, to which the gate pulses output from the gate pulse generating device are to be transferred, on the basis of the gate resolution control signals. The gate pulse generating device includes a plurality of gate stages generating the gate pulses. The gate line selection device includes a plurality of gate serial switches and a plurality of gate parallel switches. The plurality of gate serial switches respectively connect the plurality of gate stages to the plurality of gate lines. Each of the plurality of gate parallel switches connects two adjacent gate lines.

In another aspect, a data driver comprises a data resolution control signal output device outputting data resolution control signals, a latch device storing pieces of image data, a shift register device generating data storage control signals which allow a plurality of latches included in the latch device to store the pieces of image data, a latch selection device selecting latches, to which the data storage control signals output from the shift register device are to be transferred, on the basis of the data resolution control signals, a digital-to-analog conversion device generating data voltages which are to be output to a plurality of data lines, on the basis of the pieces of image data transferred from the latch device, and a data buffer device simultaneously outputting the data voltages to the plurality of data lines. The data resolution control signal output device includes a data resolution signal storage unit storing data resolution signals corresponding to the plurality of data lines and a data resolution control signal output unit transferring the data resolution control signals, generated based on the data resolution signals, to the latch selection device.

In another aspect, a display apparatus comprises a display panel displaying an image, a data driver supplying data voltages to a plurality of data lines included in the display panel, a gate driver supplying gate pulses to a plurality of gate lines included in the display panel, and a controller controlling the data driver and the gate driver.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain principles of the disclosure. In the drawings.

DETAILED DESCRIPTION

Figure 1:
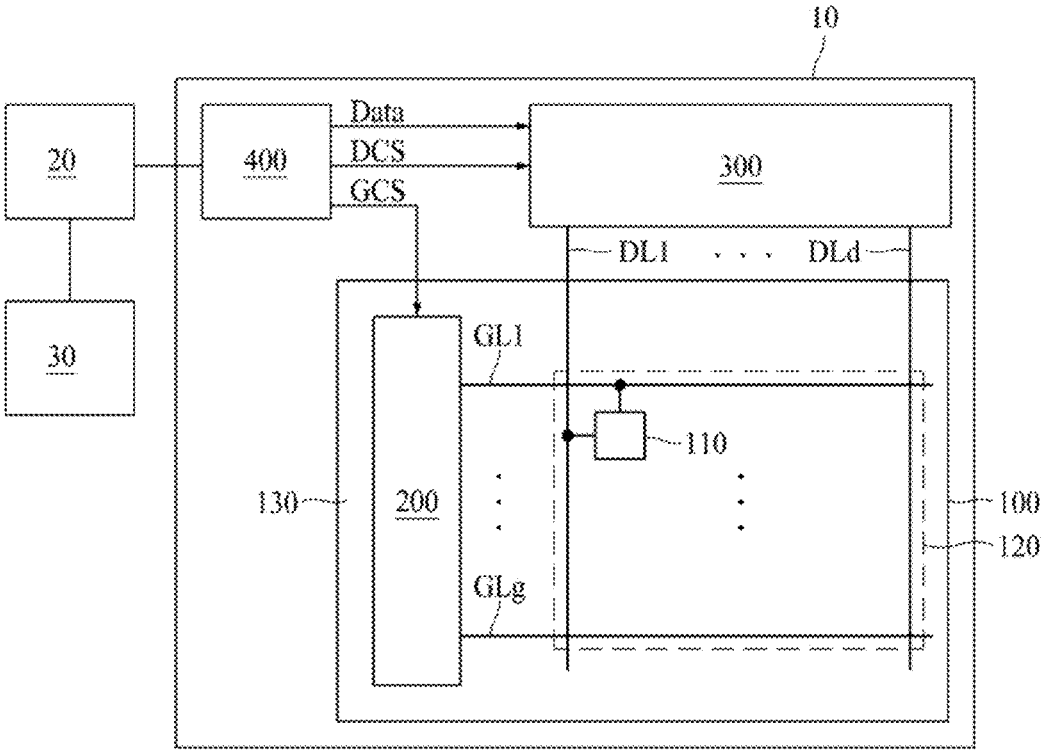
FIG. 1 is an exemplary diagram illustrating a configuration of a display apparatus according to the present disclosure.

Reference will now be made in detail to exemplary embodiments of the present disclosure, examples of which are illustrated in the accompanying drawings. Wherever possible, the same reference numbers will be used throughout the drawings to refer to the same or like parts.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted. In a case where 'comprise', 'have', and 'include' described in the present specification are used, another part may be added unless 'only~' is used. The terms of a singular form may include plural forms unless referred to the contrary.

In construing an element, the element is construed as including an error range although there is no explicit description.

In describing a position relationship, for example, when a position relation between two parts is described as 'on~', 'over~', 'under~', and 'next~', one or more other parts may be disposed between the two parts unless 'just' or 'direct' is used.

In describing a time relationship, for example, when the temporal order is described as 'after~', 'subsequent~', 'next~', and 'before~', a case which is not continuous may be included unless 'just' or 'direct' is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

In describing the elements of the present disclosure, terms such as first, second, A, B, (a), (b), etc., may be used. Such terms are used for merely discriminating the corresponding elements from other elements and the corresponding elements are not limited in their essence, sequence, or precedence by the terms. It will be understood that when an element or layer is referred to as being "on" or "connected to" another element or layer, it can be directly on or directly connected to the other element or layer, or intervening elements or layers may be present. Also, it should be understood that when one element is disposed on or under another element, this may denote a case where the elements are disposed to directly contact each other, but may denote that the elements are disposed without directly contacting each other.

The term "at least one" should be understood as including any and all combinations of one or more of the associated listed elements. For example, the meaning of "at least one of a first element, a second element, and a third element" denotes the combination of all elements proposed from two or more of the first element, the second element, and the third element as well as the first element, the second element, or the third element.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, embodiments of the present disclosure will be described in detail with reference to the accompanying drawings.

Figure 2A:
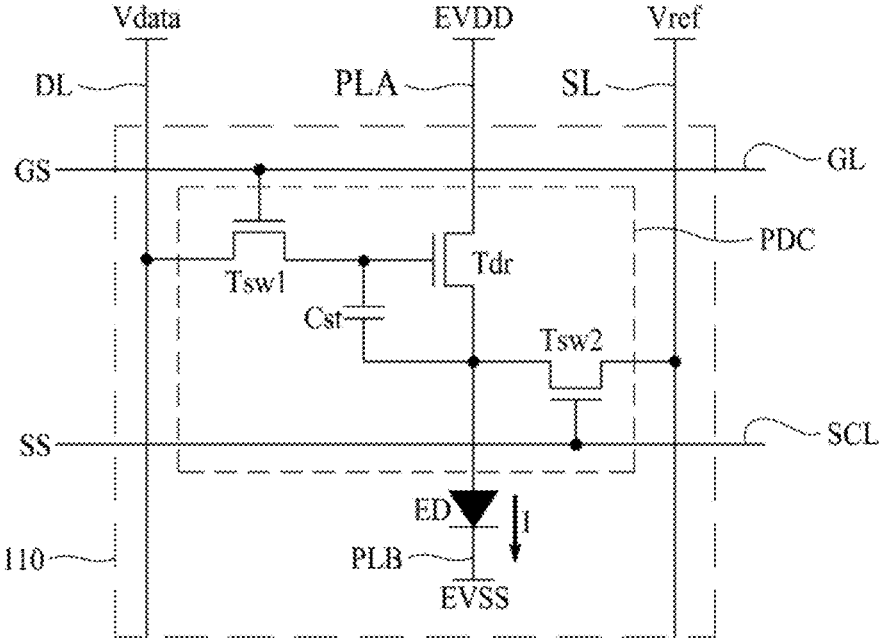
FIGS. 2A and 2B are exemplary diagrams illustrating a structure of a pixel applied to a display apparatus according to the present disclosure.
Figure 2B:
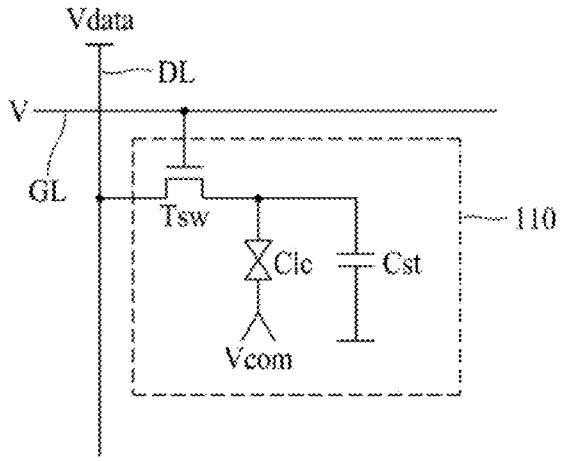
Figure 3:
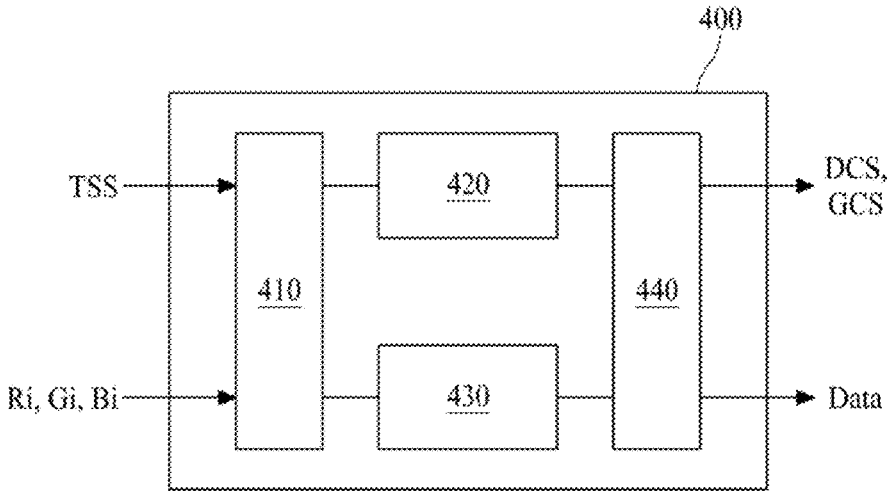
FIG. 3 is an exemplary diagram illustrating a configuration of a controller applied to a display apparatus according to the present disclosure.

FIG. 1 is an exemplary diagram illustrating a configuration of a display apparatus according to the present disclosure, FIGS. 2A and 2B are exemplary diagrams illustrating a structure of a pixel applied to a display apparatus according to the present disclosure, and FIG. 3 is an exemplary diagram illustrating a configuration of a controller applied to a display apparatus according to the present disclosure.

The display apparatus according to the present disclosure may be included in various kinds of electronic devices, and for example, may be included in virtual reality (VR) devices. That is, an electronic device may include an external system 20, a sensor 30, and a display apparatus 10.

The display apparatus 10 according to the present disclosure, as illustrated in FIG. 1, may include a display panel 100 which includes a display area 120 displaying an image and a non-display area 130 provided outside the display area 120, a gate driver 200 which supplies a gate signal GS to a plurality of gate lines GL1 to GLg included in the display area 120 of the display panel 100, a data driver 300 which supplies data voltages to a plurality of data lines DL1 to DLd included in the display panel 100, and a controller 400 which controls the gate driver 200 and the data driver 300.

The external system 20 configuring the electronic device may generate information about a focus position of eyes of a user by using pieces of sensing information received from the sensor 30 configuring the electronic device, and the information about the focus position may be transferred from the external system 20 to the controller 400.

That is, the external system 20 may perform a function of driving the controller 400 and the electronic device. Particularly, the external system 20 may receive various sound information, image information, and text information over a wired communication network or a wireless communication network and may transfer the received image information to the controller 400. The image information may include pieces of input image data input to the controller 40. Also, the external system 20 may generate information (hereinafter simply referred to as focus information) about the focus position of the eyes of the user by using pieces of sensing information received from the sensor 30 and may transfer the generated focus information to the controller 400.

Hereinafter, configurations and functions of the elements included in the display apparatus 10 will be described.

First, the display panel 100 may include the display area 120 and the non-display area 130. The gate lines GL1 to GLg, the data lines DL1 to DLd, and a plurality of pixels 110 may be included in the display area 120.

The display panel 100 may be an organic light emitting display panel configured with a light emitting device ED, or may be a liquid crystal display panel which displays an image by using a liquid crystal.

As illustrated in FIG. 2A, for example, when the display panel 100 is the light emitting display panel, the pixel 110 included in the display panel 100 may include the light emitting device ED, a switching transistor Tsw1, a storage capacitor Cst, a driving transistor Tdr, and a sensing transistor Tsw2. That is, the pixel 110 may include a pixel driving circuit PDC and a light emitting unit, and the pixel driving circuit PDC may include the switching transistor Tsw1, the storage capacitor Cst, the driving transistor Tdr, and the sensing transistor Tsw2. The light emitting unit may include the light emitting device ED.

The light emitting device ED may include one of an organic light emitting layer, an inorganic light emitting layer, and a quantum dot light emitting layer, or may include a stack or combination structure of the organic light emitting layer (or the inorganic light emitting layer) and the quantum dot light emitting layer.

The switching transistor Tsw1 configuring the pixel driving circuit PDC may be turned on or off based on the gate signal GS supplied through a gate line GL corresponding thereto, and when the switching transistor Tsw1 is turned on, a data voltage Vdata supplied through a data line DL may be supplied to the driving transistor Tdr. A first voltage EVDD may be supplied to the driving transistor Tdr and the light emitting device ED through a first voltage supply line PLA, and a second voltage EVSS may be supplied to the light emitting device ED through a second voltage supply line PLB. The sensing transistor Tsw2 may be turned on or off based a sensing control signal SS supplied through a sensing control line SCL, and a sensing line SL may be connected to the sensing transistor Tsw2. A reference voltage Vref may be supplied to the pixel 110 through the sensing line SL, and a sensing signal associated with a characteristic variation of the driving transistor Tdr may be transferred to the sensing line SL through the sensing transistor Tsw2.

The light emitting display panel applied to the present disclosure may be implemented in a structure illustrated in FIG. 2A, but the present disclosure is not limited thereto. Accordingly, the light emitting display panel applied to the present disclosure may be implemented as various types, in addition to the structure illustrated in FIG. 2A.

As illustrated in FIG. 2B, when the display panel 100 is the liquid crystal display panel, the pixel 110 included in the display panel 100 may include a switching transistor Tsw, a common electrode, and a liquid crystal. That is, the pixel 110 may include a pixel driving circuit PDC and a light emitting unit, and the pixel driving circuit PDC may include a switching transistor Tsw and a common electrode. Also, the light emitting unit may include the liquid crystal. In FIG. 2B, reference numeral "Clc" may denote a storage capacitance which is generated in the liquid crystal on the basis of a pixel voltage supplied to a pixel electrode connected to the switching transistor Tsw and a common voltage Vcom supplied to the common electrode.

When the display panel 100 is the liquid crystal display panel, the display apparatus may further include a backlight which irradiates light onto the liquid crystal display panel.

The display panel 100 may include the pixel area where the pixels 110 are provided and a plurality of signal lines for transferring various signals to the pixel driving circuit PDC included in the pixel 110.

For example, in the light emitting display panel including the pixel 110 illustrated in FIG. 2A, the signal lines may include the gate line GL, the data line DL, the sensing control line SCL, the first voltage supply line PLA, the second voltage supply line PLB, and the sensing line SL.

Moreover, in the liquid crystal display panel including the pixel 110 illustrated in FIG. 2B, the signal lines may include the gate line GL and the data line DL.

The data driver 300 may be included in a chip-on film (COF) attached on the display panel 100 and may be connected to a main substrate where the controller 400 is provided. In this case, lines for electrically connecting the controller 400, the data driver 300, and the display panel 100 may be provided in the COF, and to this end, the lines may be electrically connected to a plurality of pads included in the display panel 100 and the main substrate. The main substrate may be electrically connected to an external substrate with the external system mounted thereon.

The data driver 300 may be directly mounted on the display panel 100 and may be electrically connected to the main substrate.

However, the data driver 300 and the controller 400 may be implemented as one integrated circuit (IC), and the IC may be included in the COF or may be directly equipped in the display panel 100.

When the display panel 100 is the light emitting display panel, the data driver 300 may receive the sensing signal associated with a characteristic variation of the driving transistor Tdr included in the light emitting display panel and may transfer the sensing signal to the sensing line SL.

Hereinafter, a configuration and a function of the data driver 300 according to the present disclosure will be described in detail with reference to FIGS. 6 and 7.

The gate driver 200 may be implemented as an IC and may be mounted in the non-display area 130 and may be directly embedded into the non-display area 130 by using a gate-in panel (GIP) type. In a case where the GIP type is used, transistors configuring the gate driver 200 may be provided in the non-display area 130 through the same process as transistors included each of the pixels 110 of the display area 120.

When a gate pulse generated by the gate driver 200 is supplied to a gate of a switching transistor Tsw1 or Tsw2 included in the pixel 110, the switching transistor may be turned on, and thus, the pixel 110 may emit light. When a gate-off signal is supplied to a gate of a switching transistor Tsw1 or Tsw2, the switching transistor may be turned off, and thus, the pixel 110 may not emit light. The gate signal GS supplied to the gate line GL may include the gate pulse and the gate-off signal.

Hereinafter, a configuration and a function of the gate driver 200 according to the present disclosure will be described in detail with reference to FIGS. 4 and 5.

Finally, as illustrated in FIG. 3, the controller 400 may include a data aligner 430 which realigns pieces of input video data Ri, Gi, and Bi transferred from the external system 20 by using timing synchronization signals TSS transferred from the external system 20 and supplies pieces of realigned image data Data to the data driver 300, a control signal generator 420 which generates gate control signals GCS and data control signals DCS by using the timing synchronization signals TSS, an input unit 410 which receives the timing synchronization signals TSS and the pieces of input video data Ri, Gi, and Bi transferred from the external system 20 and respectively transfers the timing synchronization signals TSS and the pieces of input video data Ri, Gi, and Bi to the control signal generator 420 and the data aligner 430, and an output unit 440 which outputs pieces of image data Data generated by the data aligner 430 and the control signals DCS and GCS, generated by the control signal generator 420, to the data driver 300 or the gate driver 200.

The controller 400 may further perform a function of analyzing touch sensing signals, received through a touch panel which is embedded into the display panel 100 or is attached on the display panel 100, and sensing the occurrence or not of a touch and a touch position.

The controller 400, as described above, may receive focus information from the external system 20 and may control a resolution of the display panel by using the focus information. Gate resolution signals and data resolution signals for controlling a resolution of the display panel may be generated by the control signal generator 420. A detailed description thereof will be given below with reference to FIGS. 4 to 12 along with describing the gate driver 200 and the data driver 300.

The external system 20 may generate the focus information by using the pieces of sensing information received from the sensor 30. The sensor 30 for sensing positions of eyes of a user may be a general sensor which is currently used for sensing positions of eyes. In the present disclosure, a resolution of the display panel may vary based on the focus information received through the sensor 30 and the external system 20, and a method of generating the focus information may be outside the range of the present disclosure. That is, the focus information may be generated by various methods which are currently used. Hereinafter, therefore, a detailed description of a method of generating the focus information is omitted.

Hereinafter, as illustrated in FIG. 2A, the light emitting display panel including the light emitting device ED among various types of display panels will be described as an example of the display panel according to the present disclosure.

Figure 4:
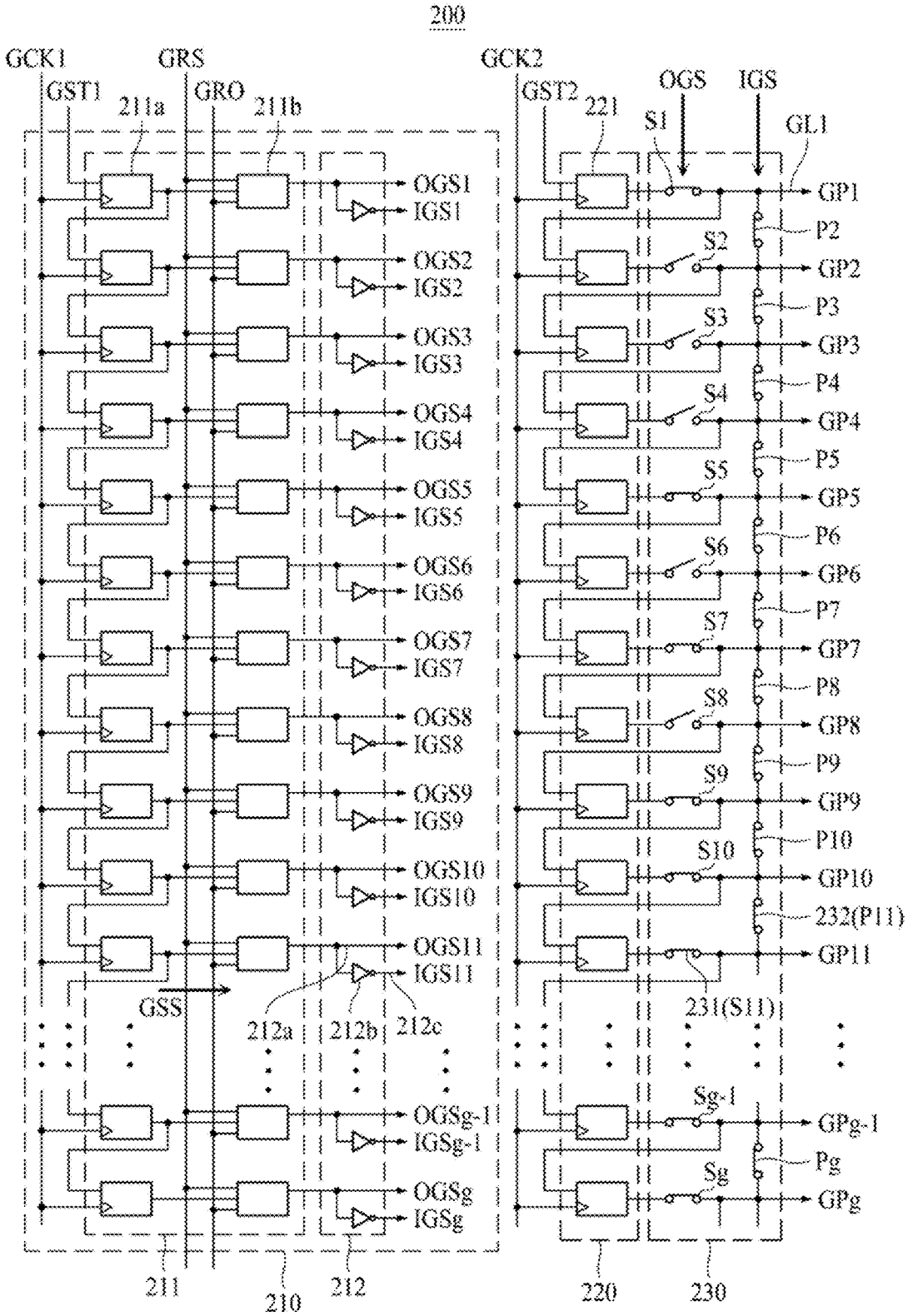
FIG. 4 is an exemplary diagram illustrating a configuration of a gate driver according to the present disclosure.
Figure 5:
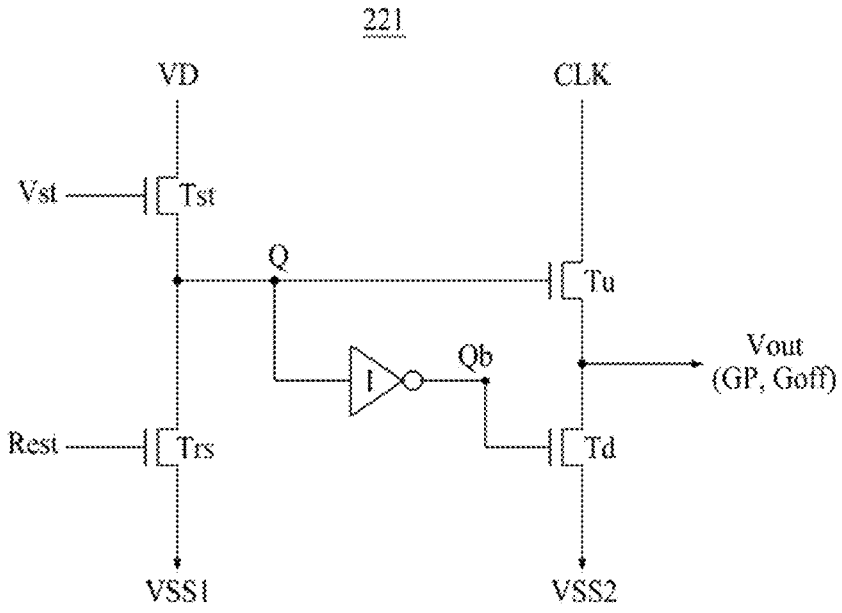
FIG. 5 is an exemplary diagram illustrating a configuration of a stage illustrated in FIG. 4.

FIG. 4 is an exemplary diagram illustrating a configuration of a gate driver 200 according to the present disclosure, and FIG. 5 is an exemplary diagram illustrating a configuration of a stage illustrated in FIG. 4.

The gate driver 200 according to the present disclosure, as illustrated in FIG. 4, may include a gate resolution control signal output device 210 which outputs gate resolution control signals OGS and IGS corresponding to a focus of eyes of a user, a gate pulse generating device 220 which generates gate pulses GP which are to be output to a plurality of gate lines GL1 to GLg, and a gate line selection device 230 which selects gate lines, to which gate pulses GP1 to GPg output from the gate pulse generating device 220 are to be transferred, on the basis of the gate resolution control signals OGS and IGS.

First, the gate resolution control signal output device 210 may sequentially store gate resolution signals GRS sequentially transferred from the controller 400 and may simultaneously output the sequentially stored gate resolution signals GRS on the basis of a gate resolution output signal GRO transferred from the controller 400. Accordingly, the gate resolution signals GRS and the gate resolution output signal GRO may be included in the gate control signals GCS.

Based on focus information, for example, the controller 400 may determine pixels for displaying a high resolution, pixels for displaying a middle resolution, and pixels for displaying a low resolution. Therefore, the controller 400 may determine positions of high resolution gate lines corresponding to the pixels for displaying a high resolution, positions of middle resolution gate lines corresponding to the pixels for displaying a middle resolution, and positions of low resolution gate lines corresponding to the pixels for displaying a low resolution.

Therefore, the controller 400 may generate gate resolution signals GRS indicating high resolution gate lines, gate resolution signals GRS indicating middle resolution gate lines, and gate resolution signals GRS indicating low resolution gate lines and may transfer the gate resolution signals GRS to the gate resolution control signal output device 210.

Moreover, the controller 400 may generate the gate resolution output signal GRO indicating a timing at which the gate resolution signals GRS are to be output and may transfer the gate resolution signals GRS to the gate resolution control signal output device 210.

The gate resolution signals GRS and the gate resolution output signal GRO may be generated by the control signal generator 420 by using focus information and timing signals TSS.

In order to perform a function described above, the gate resolution control signal output device 210 may include a gate resolution signal storage unit 211 which stores the gate resolution signals GRS corresponding to the gate lines GL1 to GLg and a gate resolution control signal output unit 212 which transfers the gate resolution control signals OGS and IGS, generated based on the gate resolution signals GRS, to the gate line selection device 230.

First, the gate resolution signal storage unit 211 may sequentially store the gate resolution signals GRS sequentially transferred from the controller 400 and may simultaneously output the sequentially stored gate resolution signals GRS.

To this end, the gate resolution signal storage unit 211 may include a plurality of gate resolution signal storages 211*b*, which store the gate resolution signals GRS corresponding to the gate lines GL1 to GLg and simultaneously output the gate resolution signals GRS, and a plurality of gate resolution signal registers 211*a* which sequentially drive the gate resolution signal storages 211*b* to allow the gate resolution signals GRS to be sequentially stored in the gate resolution signal storages 211*b*.

The gate resolution signal storage 211*b* may perform a function of a memory. The gate resolution signal storage 211*b* may be activated based on a gate shift signal GSS output from the gate resolution signal register 211*a* and may store the gate resolution signal GRS which is transferred when the gate shift signal GSS is supplied.

That is, the gate resolution signal storages 211*b* may be sequentially activated by the gate shift signal GSS, and thus, one gate resolution signal GRS may be stored in a corresponding gate resolution signal storage 211*b*.

The gate resolution signals GRS may be stored in all of the gate resolution signal storages 211*b*, and then, when the gate resolution output signal GRO is supplied to all of the gate resolution signal storages 211*b*, all of the gate resolution signal storages 211*b* may simultaneously output the gate resolution signals GRS on the basis of the gate resolution output signal GRO.

The gate resolution signal registers 211*a* may sequentially drive the gate resolution signal storages 211*b* to allow the gate resolution signals GRS to be sequentially stored in the gate resolution signal storages 211*b*.

To this end, each of the gate resolution signal registers 211*a* may be connected to a corresponding gate resolution signal storage 211*b*.

The controller 400 may supply a gate resolution signal control start signal GST1 and at least one gate resolution signal control clock GCK1 to the gate resolution signal registers 211*a*. The gate resolution signal control start signal GST1 and the gate resolution signal control clock GCK1 may be included in the gate control signals GCS.

For example, in the gate driver 200 illustrated in FIG. 4, a first gate resolution signal register provided at an uppermost end among the gate resolution signal registers 211*a* may be driven by the gate resolution signal control start signal GST1 to generate a first gate shift signal by using the gate resolution signal control clock GCK1, and the first gate shift signal may be supplied to a first gate resolution signal storage provided at an uppermost end among the gate resolution signal registers 211*b*. The first gate resolution signal storage may be driven based on the first gate shift signal and may store the gate resolution signal GRS input on the basis of the first gate shift signal.

The first gate shift signal may be transferred to a second gate resolution signal register, and thus, the second gate resolution signal register may start to drive. The second gate resolution signal register driven based on the first gate shift signal may generate a second gate shift signal by using the gate resolution signal control clock GCK1, and the second gate shift signal may be supplied to a second gate resolution signal storage. The second gate resolution signal storage may be driven based on the second gate shift signal and may store the gate resolution signal GRS input on the basis of the second gate shift signal.

When the number of gate lines GL1 to GLg is g number as illustrated in FIG. 1, operations described above may be repeated a minimum of g times.

For example, a $g-1^{th}$ gate shift signal may be transferred to a $g^{th}$ gate resolution signal register, and thus, the $g^{th}$ gate resolution signal register may start to drive. The $g^{th}$ gate resolution signal register driven based on the $g-1^{th}$ gate shift signal may generate a $g^{th}$ gate shift signal by using the gate resolution signal control clock GCK1, and the $g^{th}$ gate shift signal may be supplied to a $g^{th}$ gate resolution signal storage. The $g^{th}$ gate resolution signal storage may be driven based on the $g^{th}$ gate shift signal and may store the gate resolution signal GRS input on the basis of the $g^{th}$ gate shift signal.

In a case where the display apparatus according to the present disclosure includes two or more gate drivers and one gate driver is connected to fewer gate lines than g number, reference numeral "g" illustrated in the gate driver of FIG. 4 may be illustrated as "e" representing a natural number which is smaller than g number.

Second, the gate resolution control signal output unit 212 may transfer the gate resolution control signals OGS and IGS, generated based on the gate resolution signals GRS, to the gate line selection device 230.

To this end, the gate resolution control signal output unit 212 may include a plurality of original gate resolution control signal lines 212*a* which transfer original gate resolution control signals OGS, corresponding to gate resolution signals output from the gate resolution signal storage unit 211, to the gate line selection device 230, a plurality of gate inverters 212*b* which invert the original gate resolution control signals OGS, and a plurality of inversion gate resolution control signal lines 212*c* which transfer inverted gate resolution control signals IGS, output from the gate inverters 212*b*, to the gate line selection device 230.

For example, a gate resolution signal which is stored and then output by one gate resolution signal storage 211*b* may be the original gate resolution control signal OGS. The original gate resolution control signal OGS may be transferred to the gate line selection device 230 through the original gate resolution control signal line 212*a*.

A gate resolution signal (i.e., the original gate resolution control signal OGS) output from one gate resolution signal storage 211*b* may be inverted by the gate inverter 212*b*, and thus, may be the inverted gate resolution control signal IGS.

The inverted gate resolution control signal IGS may be transferred to the gate line selection device 230 through the inversion gate resolution control signal line 212*c*.

In this case, a first original gate resolution control signal OGS1 may be output through an original gate resolution control signal line 212*a* provided at an uppermost end among the plurality of original gate resolution control signal lines 212*a*, a first inverted gate resolution control signal IGS1 may be output through an inversion gate resolution control signal line 212*c* provided at an uppermost end among the plurality of inversion gate resolution control signal lines 212*c*, a $g^{th}$ original gate resolution control signal OGSg may be output through an original gate resolution control signal line 212*a* provided at a lowermost end among the plurality of original gate resolution control signal lines 212*a*, and a $g^{th}$ inverted gate resolution control signal IGSg may be output through an inversion gate resolution control signal line 212*c* provided at a lowermost end among the plurality of inversion gate resolution control signal lines 212*c*.

Subsequently, the gate pulse generating device 220 may generate gate pulses GP which are to be output to the gate lines GL1 to GLg.

To this end, the gate pulse generating device 220 may include a plurality of gate stages 221 which generate the gate pulses GP.

The gate stages 221 may be sequentially driven and may generate the gate pulses GP.

Output lines of the gate stages 221 may be connected to the gate line selection device 230.

The controller 400 may supply a gate start signal GST2 and at least one gate clock GCK2 to the gate stages 221. The gate start signal GST2 and the at least one gate clock GCK2 may be included in the gate control signals GCS.

For example, in the gate driver illustrated in FIG. 4, a first gate stage provided at an uppermost end among the gate stages 221 may start to drive based on the gate start signal GST2 and may generate a first gate pulse GP1 by using a gate clock GCK2, and the first gate pulse GP1 may be supplied to a first gate line GL1 provided at an uppermost end among the plurality of gate lines.

The first gate pulse GP1 may be transferred to a second gate stage, and thus, the second gate stage may start to drive. The second gate stage driven based on the first gate pulse GP1 may generate a second gate pulse GP2 by using the gate clock GCK2, and the second gate pulse GP2 may be supplied to a second gate line GL2.

When the number of gate lines GL1 to GLg is g number as illustrated in FIG. 1, operations described above may be repeated a minimum of g times.

For example, a $g-1^{th}$ gate pulse GPg−1 may be transferred to a $g^{th}$ gate stage, and thus, the $g^{th}$ gate stage may start to drive. The $g^{th}$ gate stage driven based on the $g-1^{th}$ gate pulse GPg−1 may generate a $g^{th}$ gate pulse GPg by using the gate clock GCK2, and the $g^{th}$ gate pulse GPg may be supplied to a $g^{th}$ gate line GLg.

FIG. 5 illustrates an exemplary diagram of the gate stage 221 for performing a function described above.

The gate stage 221 may include a plurality of transistors. In FIG. 5, a gate stage including four transistors Tst, Trs, Tu, and Td is illustrated as an example of the gate stage 221 applied to the present disclosure.

The start transistor Tst may be turned on based on the start signal Vst and may transfer a high voltage VD to a gate of a pull-up transistor Tu through a Q node Q. Here, the start signal Vst may be the gate start signal GST2 transferred from the controller 400, or may be the gate pulse GP which is transferred to a previous gate stage.

The pull-up transistor Tu may be turned on based on the high voltage VD and may output a clock CLK to the gate line GL. In this case, the gate pulse GP having a high value may be output to the gate line GL.

The high voltage VD passing through the start transistor Tst may be converted into a low voltage by an inverter I, and the low voltage may be supplied to a gate of a pull-down transistor Td through a Qb node Qb. Accordingly, the pull-down transistor Td may be turned off.

When the start transistor Tst is turned off and a reset transistor Trs is turned on based on a reset signal Rest, a first low voltage VSS1 may be supplied to the pull-up transistor Tu through the reset transistor Trs, and thus, the pull-up transistor Tu may be turned off.

The first low voltage VSS1 may be converted into a high voltage by the inverter I, and the high voltage may be supplied to a gate of the pull-down transistor Td through the Qb node Qb. Therefore, the pull-down transistor Td may be turned on. In this case, a second low voltage VSS2 may be supplied to the gate line GL through the pull-down transistor Td. The second low voltage VSS2 supplied to the gate line GL through the pull-down transistor Td may be a gate-off signal Goff.

When the gate pulse GP is supplied to a gate of the switching transistor Tsw1 included in the pixel 110 illustrated in FIG. 2A, the switching transistor Tsw1 may be turned on, and thus, the pixel 110 may display an image. When the gate-off signal Goff is supplied to the switching transistor Tsw1, the switching transistor Tsw1 may be turned off, and thus, the pixel 110 may not display an image.

Here, a generic term for the gate pulse GP and the gate-off signal Goff may be referred to as a gate signal GS. That is, the gate stage 221 may output the gate pulse GP and the gate-off signal Goff to the gate line GL.

However, a structure and a function of the gate stage 221 may be various modified in addition to a structure and a function described above with reference to FIG. 5.

The gate resolution signal registers 211*a* may also be implemented as a type similar to the gate stage 221 illustrated in FIG. 5. That is, the gate stages 221 may be sequentially driven and may output the gate pulses GP, and the gate resolution signal registers 211*a* may be sequentially driven and may output a plurality of gate shift signals GSS.

Finally, the gate line selection device 230 may select gate lines, to which the gate pulses output from the gate pulse generating device 220 are to be transferred, on the basis of the gate resolution control signals OGS and IGS.

To this end, the gate line selection device 230 may include a plurality of gate serial switches 231 and a plurality of gate parallel switches 232.

The gate serial switches 231 may respectively connect the gate stages 221 to the gate lines in one-to-one relationship.

Each of the gate parallel switches 232 may connect two gate lines adjacent to each other in one-to-one relationship.

Each of the gate serial switches 231 may be turned on or off based on the original gate resolution control signal OGS output from the gate resolution control signal output device 210, and each of the gate parallel switches 232 may be turned on or off based on the inverted gate resolution control signal IGS output from the gate resolution control signal output device 210.

As described above, the inverted gate resolution control signal IGS may be a signal obtained by inverting the original gate resolution control signal OGS.

In this case, in the gate line selection device 230 illustrated in FIG. 4, a gate serial switch 231 provided at an uppermost end may be a first gate serial switch S1, a gate serial switch provided thereunder may be a second gate serial switch S2, and a plurality of gate serial switches provided thereunder may be third to $g^{th}$ gate serial switches S3 to Sg.

Moreover, in the gate line selection device 230 illustrated in FIG. 4, a gate parallel switch 232 provided at an uppermost end may be a second gate parallel switch P2, a gate parallel switch provided thereunder may be a third gate parallel switch P3, and a plurality of gate parallel switches provided thereunder may be fourth to $g^{th}$ gate parallel switches P4 to Pg.

When an $m^{th}$ (where m is a natural number less than g) gate serial switch among the gate serial switches 231 is turned on, an $m^{th}$ gate pulse transferred from an $m^{th}$ gate stage to an $m^{th}$ gate serial switch may be output to an $m^{th}$ gate line connected to the $m^{th}$ gate serial switch.

In this case, the $m^{th}$ gate pulse may be output to at least one gate line (for example, an $m+1^{th}$ gate line), which is adjacent to the $m^{th}$ gate line, through at least one gate parallel switch (for example, an $m+1^{th}$ gate parallel switch) connected to the $m^{th}$ gate line.

For example, in FIG. 4, when the first gate serial switch S1 is turned on, the first gate pulse GP1 transferred from the first gate switch to the first gate serial switch S1 may be output to the first gate line GL1 connected to the first gate serial switch S1.

Moreover, the first gate pulse GP1 may be output to at least one gate line (for example, the second gate line GL2), which is adjacent to the first gate line, through at least one gate parallel switch (for example, the second gate parallel switch P2) connected to the first gate line GL1. In this case, the first gate pulse GP1 may be output to the third gate line GL3 through the third gate parallel switch P3, or may be output to the fourth gate line GL4 through the fourth gate parallel switch. That is, the first gate pulse GP1 may be output to the first to fourth gate lines GL1 to GL4.

Moreover, the $m^{th}$ gate pulse may be transferred to one of a plurality of gate stages, provided subsequent to the $m^{th}$ gate stage, through at least one gate parallel switch connected to the $m^{th}$ gate line.

For example, in FIG. 4, the first gate pulse GP1 may be transferred to a gate stage (for example, the second gate stage), provided next to the first gate stage, through at least one gate parallel switch (for example, the second gate parallel switch P2) connected to the first gate line GL1. In this case, the first gate pulse GP1 may be output to the third gate stage through the second gate parallel switch P2 and the third gate parallel switch P3, or may be output to the fourth gate stage through the second gate parallel switch P2, the third gate parallel switch P3, and the fourth gate parallel switch. That is, after the first gate stage is driven, the second gate stage may also be driven, the third gate stage may also be driven, or the fourth gate stage may also be driven.

Based on a method described above, the gate stages 221 may be driven in various orders and may generate the gate pulses GP, and moreover, a combination of gate lines outputting the same gate pulses may be variously modified.

According to the present disclosure, even when all of the gate stages 221 are not driven, the gate pulses GP1 to GPg may be supplied to all of the gate lines GL1 to GLg. Accordingly, according to the present disclosure, consumption power for driving the gate stages 221 may be reduced.

Moreover, a gate buffer device may be further provided between the gate line selection device 230 and the gate lines. The gate buffer device may perform a function of simultaneously outputting the same gate pulses to the gate lines.

That is, as described above, the same gate pulses may be supplied to at least two gate lines adjacent to one another. In this case, when a timing for substantially outputting the same gate pulses to the gate lines is changed by various factors, an image may not normally be displayed. In order to solve such a problem, a gate buffer device may be further provided between the gate line selection device 230 and the gate lines. The gate buffer device may include a plurality of gate buffers connected to the gate lines.

Figure 6:
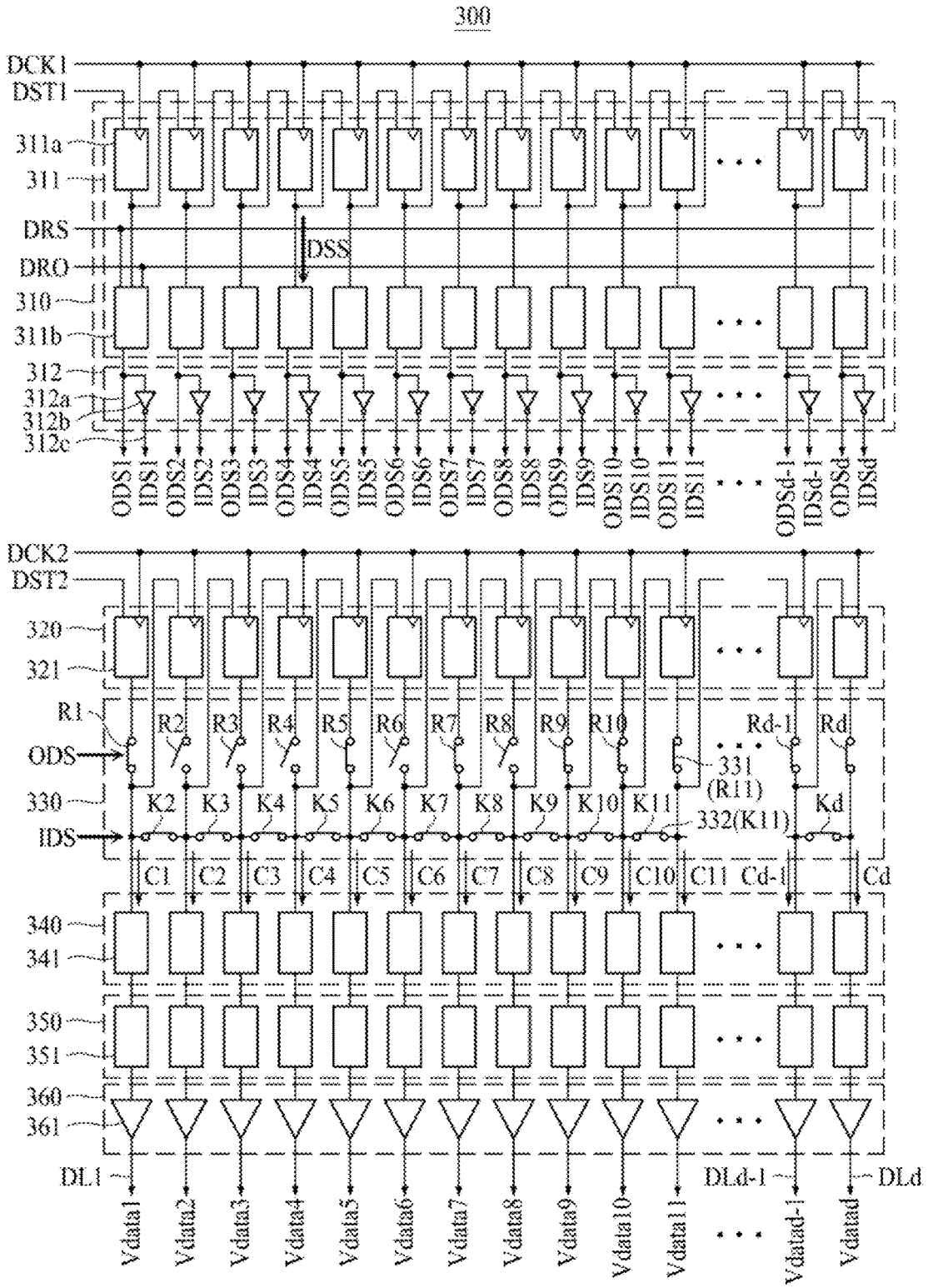
FIG. 6 is an exemplary diagram illustrating a configuration of a data driver according to the present disclosure.
Figure 7:
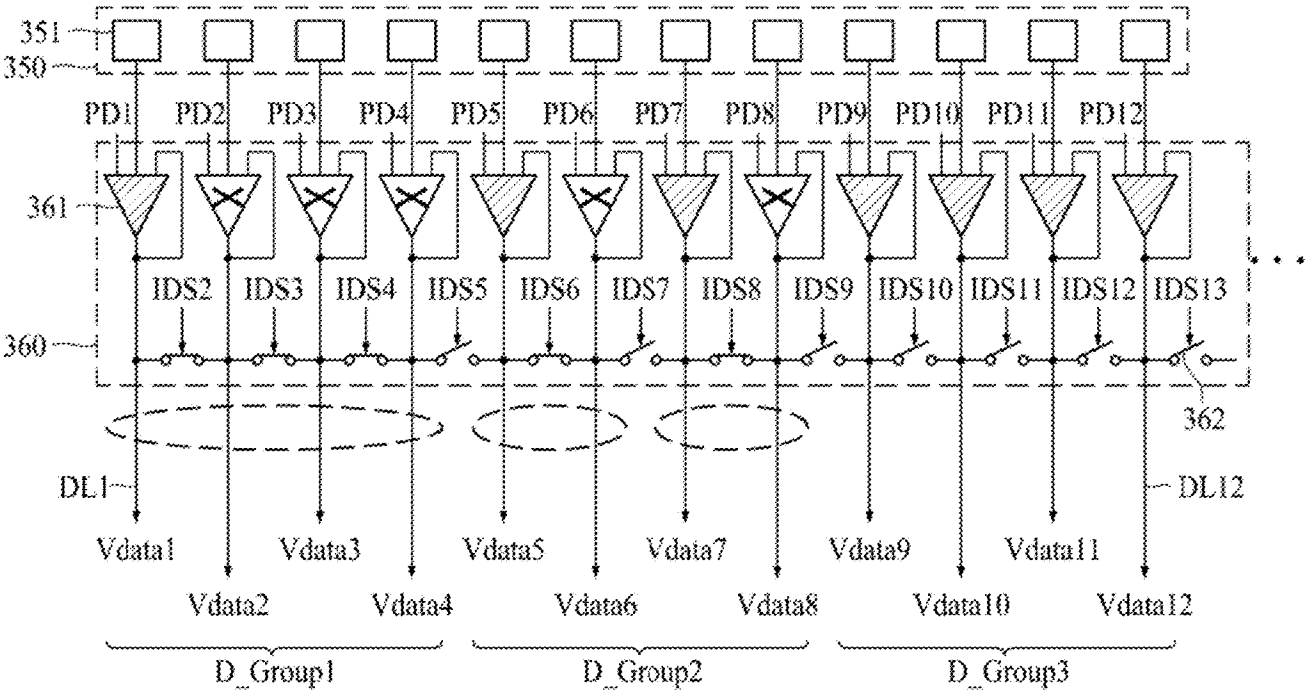
FIG. 7 is an exemplary diagram illustrating a configuration of a data buffer device illustrated in FIG. 6.

FIG. 6 is an exemplary diagram illustrating a configuration of a data driver 300 according to the present disclosure, and FIG. 7 is an exemplary diagram illustrating a configuration of a data buffer device illustrated in FIG. 6.

The data driver 300 according to the present disclosure, as illustrated in FIG. 6, may include a data resolution control signal output device 310 which outputs data resolution control signals ODS and IDS corresponding to a focus of eyes of a user, a latch device 340 which stores pieces of image data Data, a shift register device 320 which generates data storage control signals C1 to Cd for allowing a plurality of latches 341 included in the latch device 340 to store the pieces of image data Data, a latch selection device 330 which selects a plurality of latches, to which the data storage control signals C1 to Cd output from the shift register device 320 are to be transferred, on the basis of the data resolution control signals ODS and IDS, a digital-to-analog conversion device 350 which generates data voltages Vdata1 to Vdatad which are to be output to a plurality of data lines DL1 to DLd, on the basis of pieces of image data transferred from the latch device 340, and a data buffer device 360 which simultaneously outputs the data voltages Vdata1 to Vdatad to the plurality of data lines DL1 to DLd.

First, the data resolution control signal output device 310 may sequentially store data resolution signals DRS sequentially transferred from the controller 400 and may simultaneously output the sequentially stored data resolution signals DRS on the basis of a data resolution output signal DRO transferred from the controller 400. Accordingly, the data resolution signals DRS and the data resolution output signal DRO may be included in the data control signals DCS.

The controller 400 may determine positions of pixels for displaying a high resolution, positions of pixels for displaying a middle resolution, and positions of pixels for displaying a low resolution. Therefore, the controller 400 may determine positions of high resolution data lines corresponding to the pixels for displaying a high resolution, positions of middle resolution data lines corresponding to the pixels for displaying a middle resolution, and positions of low resolution data lines corresponding to the pixels for displaying a low resolution.

Therefore, the controller 400 may generate data resolution signals DRS indicating high resolution data lines, data resolution signals DRS indicating middle resolution data lines, and data resolution signals DRS indicating low resolution data lines and may transfer the data resolution signals DRS to the data resolution control signal output device 310.

Moreover, the controller 400 may generate the data resolution output signal DRO indicating a timing at which the data resolution signals DRS are to be output and may transfer the data resolution signals DRS to the data resolution control signal output device 310.

The data resolution signals DRS and the data resolution output signal DRO may be generated by the control signal generator 420 by using the focus information and the timing signals TSS.

In order to perform a function described above, the data resolution control signal output device 310 may include a data resolution signal storage unit 311 which stores the data resolution signals DRS corresponding to the data lines DL1 to DLd and a data resolution control signal output unit 312 which transfers the data resolution control signals ODS and IDS, generated based on the data resolution signals DRS, to the latch selection device 330.

First, the data resolution signal storage unit 311 may sequentially store the data resolution signals DRS sequentially transferred from the controller 400 and may simultaneously output the sequentially stored data resolution signals DRS.

To this end, the data resolution signal storage unit 311 may include a plurality of data resolution signal storages 311*b*, which store the data resolution signals DRS corresponding to the data lines DL1 to DLd and simultaneously output the data resolution signals DRS, and a plurality of data resolution signal registers 311*a* which sequentially drive the data resolution signal storages 311*b* to allow the data resolution signals DRS to be sequentially stored in the data resolution signal storages 311*b*.

The data resolution signal storage 311*b* may perform a function of a memory. The data resolution signal storage 311*b* may be activated based on a data shift signal DSS output from the data resolution signal register 311*a* and may store the data resolution signal DRS which is transferred when the data shift signal DSS is supplied.

That is, the data resolution signal storages 311*b* may be sequentially activated by the data shift signal DSS, and thus, one data resolution signal DRS may be stored in a corresponding data resolution signal storage 311*b*.

The data resolution signals DRS may be stored in all of the data resolution signal storages 311*b*, and then, when the data resolution output signal DRO is supplied to all of the data resolution signal storages 311*b*, all of the data resolution signal storages 311*b* may simultaneously output the data resolution signals DRS on the basis of the data resolution output signal DRO.

The data resolution signal registers 311*a* may sequentially drive the data resolution signal storages 311*b* to allow the data resolution signals DRS to be sequentially stored in the data resolution signal storages 311*b*.

To this end, each of the data resolution signal registers 311*a* may be connected to a corresponding data resolution signal storage 311*b*.

The controller 400 may supply a data resolution signal control start signal DST1 and at least one data resolution signal control clock DCK1 to the data resolution signal registers 311*a*. The data resolution signal control start signal DST1 and the data resolution signal control clock DCK1 may be included in the data control signals DCS.

Figure 9:
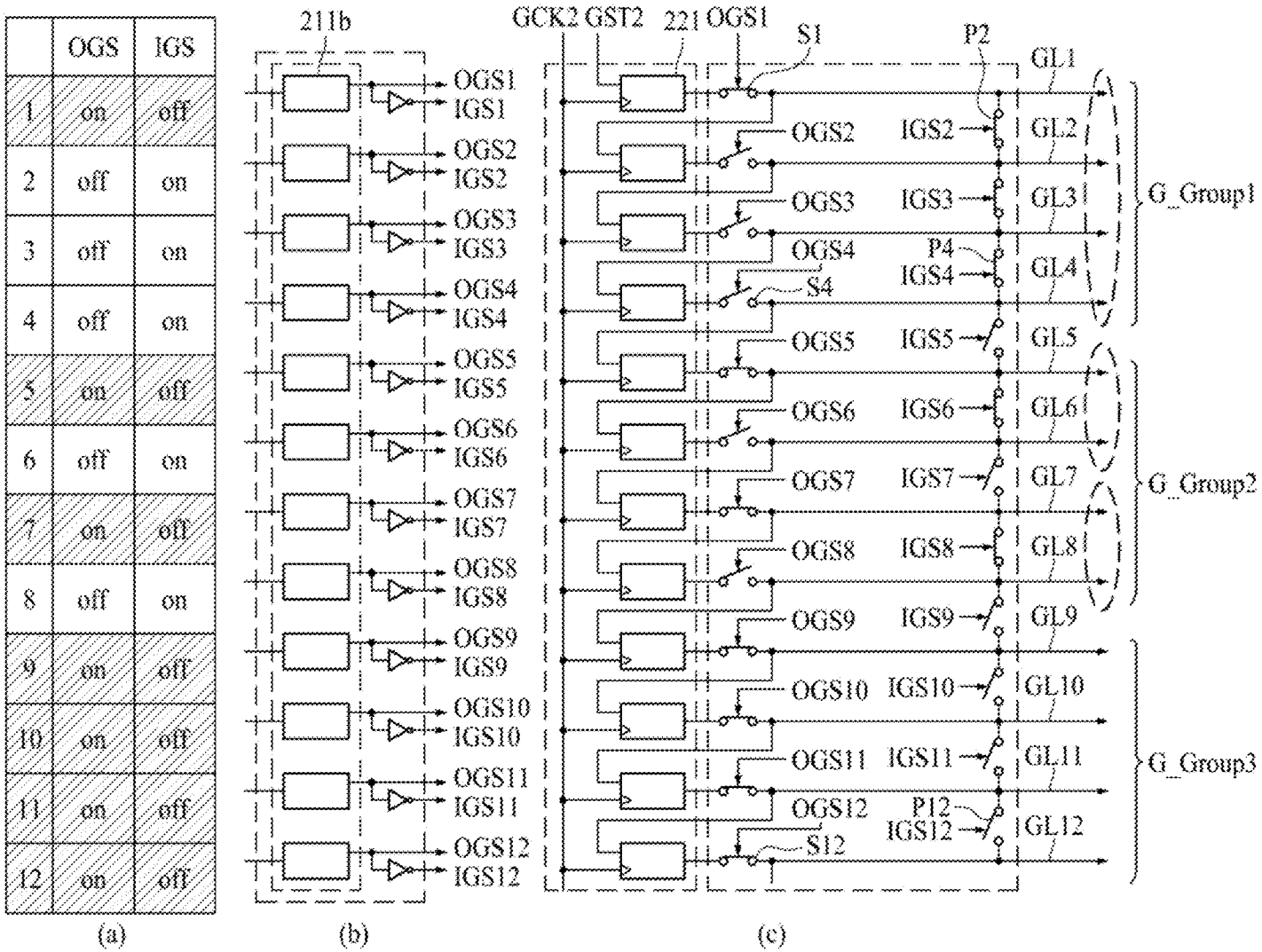
FIG. 9 is an exemplary diagram for describing a method of realizing a high resolution, a middle resolution, and a low resolution by using a gate driver according to the present disclosure.

For example, in the data driver 300 illustrated in FIG. 9, a first data resolution signal register provided at a leftmost portion among the data resolution signal registers 311*a* may be driven by the data resolution signal control start signal DST1 to generate a first data shift signal by using the data resolution signal control clock DCK1, and the first data shift signal may be supplied to a first data resolution signal storage provided at a leftmost portion among the data resolution signal registers 311*b*. The first data resolution signal storage may be driven based on the first data shift signal and may store the data resolution signal DRS input on the basis of the first data shift signal.

The first data shift signal may be transferred to a second data resolution signal register, and thus, the second data resolution signal register may start to drive. The second data resolution signal register driven based on the first data shift signal may generate a second data shift signal by using the data resolution signal control clock DCK1, and the second data shift signal may be supplied to a second data resolution signal storage. The second data resolution signal storage may be driven based on the second data shift signal and may store the data resolution signal DRS input on the basis of the second data shift signal.

When the number of data lines DL1 to DLd is d number as illustrated in FIG. 1, operations described above may be repeated a minimum of d times.

For example, a $d-1^{th}$ data shift signal may be transferred to a $d^{th}$ data resolution signal register, and thus, the $d^{th}$ data resolution signal register may start to drive. The $d^{th}$ data resolution signal register driven based on the $d-1^{th}$ data shift signal may generate a $d^{th}$ data shift signal by using the data resolution signal control clock DCK1, and the $d^{th}$ data shift signal may be supplied to a $d^{th}$ data resolution signal storage. The $d^{th}$ data resolution signal storage may be driven based on the $d^{th}$ data shift signal and may store the data resolution signal DRS input on the basis of the $d^{th}$ data shift signal.

Each of the data resolution signal registers 311*a* may include a configuration which is similar to a configuration of the gate stage 221 described above with reference to FIG. 5.

In a case where the display apparatus according to the present disclosure includes two or more data drivers and one data driver is connected to fewer data lines than d number, reference numeral "d" illustrated in the data driver of FIG. 6 may be illustrated as "q" representing a natural number which is smaller than d number.

Second, the data resolution control signal output unit 312 may transfer the data resolution control signals ODS and IDS, generated based on the data resolution signals DRS, to the latch selection device 330.

To this end, the data resolution control signal output unit 312 may include a plurality of original data resolution control signal lines 312*a* which transfer original data resolution control signals ODS, corresponding to data resolution signals output from the data resolution signal storage unit 311, to the data line selection device 330, a plurality of data inverters 312*b* which invert the original data resolution control signals ODS, and a plurality of inversion data resolution control signal lines 312*c* which transfer inverted data resolution control signals IDS, output from the data inverters 312*b*, to the latch selection device 330.

For example, a data resolution signal which is stored and then output by one data resolution signal storage 311*b* may be the original data resolution control signal ODS. The original data resolution control signal ODS may be transferred to the data line selection device 330 through the original data resolution control signal line 312*a*.

A data resolution signal (i.e., the original data resolution control signal ODS) output from one data resolution signal storage 311*b* may be inverted by the data inverter 312*b*, and thus, may be the inverted data resolution control signal IDS.

The inverted data resolution control signal IDS may be transferred to the latch selection device 330 through the inversion data resolution control signal line 312*c*.

In this case, a first original data resolution control signal ODS1 may be output through an original data resolution control signal line 312*a* provided at a leftmost portion among the plurality of original data resolution control signal lines 312*a* output from the data resolution control signal output unit 312 of the data driver 300 of FIG. 6, a first inverted data resolution control signal IDS1 may be output through an inversion data resolution control signal line 312*c* provided at a leftmost portion among the plurality of inversion data resolution control signal lines 312*c*, a $d^{th}$ original data resolution control signal ODSd may be output through an original data resolution control signal line 312*a* provided at a rightmost portion among the plurality of original data resolution control signal lines 312*a*, and a $d^{th}$ inverted data resolution control signal IDSd may be output through an inversion data resolution control signal line 312*c* provided at a rightmost portion among the plurality of inversion data resolution control signal lines 312*c*.

Subsequently, the shift register device 320 may generate data storage control signals C.

To this end, the shift register device 320 may include a plurality of data stages 321 which generate the data storage control signals C.

The data stages 321 may be sequentially driven and may generate the data storage control signals C.

Output lines of the data stages 321 may be connected to the latch selection device 330.

The controller 400 may supply a data start signal DST2 and at least one gate clock DCK2 to the data stages 321. The data start signal DST2 and the at least one data clock DCK2 may be included in the data control signals DCS.

For example, in the data driver 300 illustrated in FIG. 6, a first data stage provided at a leftmost portion among the data stages 321 may start to drive based on the data start signal DST2 and may generate a first data storage control signal C1 by using a data clock DCK2, and the first data storage control signal C1 may be supplied to a first auxiliary data line which connects the first data stage to a first latch provided at a leftmost portion among the plurality of latch devices 340.

The first data storage control signal C1 may be transferred to a second data stage, and thus, the second data stage may start to drive. The second data stage driven based on the first data storage control signal C1 may generate a second data storage control signal C2 by using the data clock DCK2, and the second data storage control signal C2 may be supplied to a second auxiliary data line.

When the number of data lines DL1 to DLd is d number as illustrated in FIG. 1, operations described above may be repeated a minimum of d times.

For example, a $d-1^{th}$ data storage control signal Cd−1 may be transferred to a $d^{th}$ data stage, and thus, the $d^{th}$ data stage may start to drive. The $d^{th}$ data stage driven based on the $d-1^{th}$ data storage control signal Cd−1 may generate a $d^{th}$ data storage control signal Cd by using the data clock DCK2, and the $d^{th}$ data storage control signal Cd may be supplied to a $d^{th}$ latch provided at a rightmost portion among the plurality of latches 341 illustrated in FIG. 6.

Each of the data stages 321 may include a configuration which is similar to a configuration of the gate stage 221 described above with reference to FIG. 5.

Subsequently, the latch selection device 330 may perform a function of selecting a plurality of auxiliary data lines to which a plurality of data storage control signals C1 to Cd output from the shift register device 320 are to be transferred, on the basis of the data resolution control signals ODS and IDS.

To this end, the latch selection device 330 may include a plurality of data serial switches 331 and a plurality of data parallel switches 332.

The data serial switches 331 may respectively connect the data stages 321 to the latches 341 in one-to-one relationship.

Each of the data parallel switches 332 may connect two auxiliary data lines adjacent to each other among a plurality of auxiliary data lines which respectively connect the data serial switches 331 to the latches 341 in one-to-one relationship.

Each of the data serial switches 331 may be turned on or off based on the original data resolution control signal ODS output from the data resolution control signal output device 310, and each of the data parallel switches 332 may be turned on or off based on the inverted data resolution control signal IDS output from the data resolution control signal output device 310.

As described above, the inverted data resolution control signal IDS may be a signal obtained by inverting the original data resolution control signal ODS.

In this case, in the latch selection device 330 illustrated in FIG. 6, a data serial switch 331 provided at a leftmost portion may be a first data serial switch R1, a data serial switch provided at a right side thereof may be a second data serial switch R2, and a plurality of data serial switches provided at a right side thereof may be third to $d^{th}$ data serial switches R3 to Rd.

Moreover, in the latch selection device 330 illustrated in FIG. 6, a data parallel switch 232 provided at a leftmost portion may be a second data parallel switch K2, a data parallel switch provided at a right side thereof may be a third data parallel switch K3, and a plurality of data parallel switches provided at a right side thereof may be fourth to $d^{th}$ data parallel switches K4 to Kd.

When an $m^{th}$ data serial switch among the data serial switches 331 is turned on, an $m^{th}$ data storage control signal transferred from an $m^{th}$ data stage to an $m^{th}$ data serial switch may be output to an $m^{th}$ latch through an $m^{th}$ auxiliary data line connected to the $m^{th}$ data serial switch.

In this case, the $m^{th}$ data storage control signal may be output to at least one auxiliary data line (for example, an $m+1^{th}$ auxiliary data line), which is adjacent to the $m^{th}$ auxiliary data line, through at least one data parallel switch (for example, an $m+1^{th}$ data parallel switch) connected to the $m^{th}$ auxiliary data line.

For example, in FIG. 6, when the first data serial switch R1 is turned on, the first data storage control signal C1 transferred from the first data stage to the first data serial switch R1 may be output to the first latch through the first auxiliary data line connected to the first data serial switch R1.

Moreover, the first data storage control signal C1 may be output to at least one auxiliary data line (for example, the second auxiliary data line), which is adjacent to the first auxiliary data line, through at least one data parallel switch 332 (for example, the second data parallel switch K2) connected to the first auxiliary data line. The first data storage control signal C1 output to the second auxiliary data line may be output to the second latch. In this case, the first data storage control signal C1 may be supplied to the third auxiliary data line through the third data parallel switch K3 and may be output to a third latch, or may be supplied to a fourth auxiliary data line through a fourth data parallel switch and may be output to a fourth latch. That is, the first data storage control signal C1 may be simultaneously output to the first to fourth auxiliary data lines.

Moreover, the $m^{th}$ data storage control signal may be transferred to one of a plurality of latches, provided subsequent to the $m^{th}$ latch, through at least one data parallel switch connected to the $m^{th}$ auxiliary data line.

For example, in FIG. 6, the first data storage control signal C1 may be transferred to a data stage (for example, the second data stage), provided next to the first data stage, through at least one data parallel switch (for example, the second data parallel switch K2) connected to the first auxiliary data line. In this case, the first data storage control signal C1 may be output to the third data stage through the second data parallel switch K2 and the third data parallel switch K3, or may be output to the fourth data stage through the second data parallel switch K2, the third data parallel switch K3, and the fourth data parallel switch. That is, after the first data stage is driven, the second data stage may also be driven, the third data stage may also be driven, or the fourth data stage may also be driven.

Based on a method described above, the data stages 321 may be driven in various orders and may generate the data storage control signals C, and moreover, a combination of auxiliary data lines outputting the same data storage control signals may be variously modified.

According to the present disclosure, even when all of the data stages 321 are not driven, the data storage control signals C1 to Cd may be supplied to all of the auxiliary data lines, and thus, pieces of image data may be stored in all latches. Accordingly, according to the present disclosure, consumption power for driving the data stages 321 may be reduced.

Subsequently, the latch device 340 may sequentially store pieces of image data Data transferred from the controller 400 on the basis of the data storage control signals C.

For example, when the first data storage control signal C1 is supplied to the first latch, the first latch may store first image data, and when the second data storage control signal C2 is supplied to the second latch, the second latch may store second image data. Also, when the third data storage control signal C3 is supplied to the third latch, the third latch may store third image data.

However, based on a method described above, when the first data storage control signal C1 is supplied to the first to fourth latches, the first to fourth latches may be simultaneously driven, and thus, all of the first to fourth latches may store first image data. Also, when a fifth data storage control signal C5 is supplied to a fifth latch after the first image data is stored in the first to fourth latches, the fifth latch may store second image data. In this case, the fifth data storage control signal C5 may simultaneously be a signal generated from the first data storage control signal C1.

That is, according to the present disclosure, pieces of image data stored in the latches 341 may differ, and at least two adjacent latches 341 may store the same image data.

To provide an additional description, the latches 341 may be activated by the data storage control signal C and may store image data. Accordingly, when the same data storage control signal C is simultaneously supplied to at least two latches 341, the two latches 341 may store the same image data.

Therefore, according to the present disclosure, a period where pieces of image data are stored in the latches may be reduced.

Subsequently, the digital-to-analog conversion device 350 may generate data voltages which are to be output to the data lines, on the basis of the pieces of image data transferred from the latch device 340.

To this end, the latches 341 may simultaneously supply the pieces of image data to a plurality of conversion units 351 of the digital-to-analog conversion device 350 on the basis of the data control signal DCS, and the conversion units 351 may respectively convert the pieces of image data into the data voltages Vdata1 to Vdatad by using a gamma signal.

That is, the conversion units 351 may perform a function of converting pieces of digital image data into analog data voltages Vdata1 to Vdatad.

Finally, the data buffer device 360 may simultaneously output the data voltages Vdata1 to Vdatad, generated by the digital-to-analog conversion devices 350, to the data lines DL1 to DLd.

That is, as described above, the same data voltages may be supplied to at least two adjacent data lines. In this case, when a timing for substantially outputting the same data voltages to the data lines is changed by various factors, an image may not normally be displayed. In order to solve such a problem, the data buffer device 360 may be provided between the digital-to-analog conversion device 350 and the data lines.

To provide an additional description, the data buffer device 360 may simultaneously output data voltages to all data lines DL1 to DLd during a one-horizontal period included in a period where a gate pulse is supplied to a gate line. To this end, the data buffer device 360 may be provided between the digital-to-analog conversion device 350 and the data lines.

The data buffer device 360, as illustrated in FIG. 6, may include a plurality of data buffers 361 connected to the data lines DL1 to DLd.

In order to decrease the power consumption of the data buffers 361, the data buffer device 360 may be implemented as a type illustrated in FIG. 7(*b*).

For example, as illustrated in FIG. 7(*b*), the data buffer device 360 may include the plurality of data buffers 361, respectively connected to the conversion units 351 configuring the digital-to-analog conversion device 350, and a plurality of buffer parallel switches 362.

Each of the buffer parallel switches 362 may connect two adjacent data lines. Particularly, a buffer parallel switch provided at a leftmost portion among the buffer parallel switches 362 illustrated in FIG. 7(*b*) may be a second buffer switch, and a plurality of buffer parallel switches provided at a right portion among the buffer parallel switches 362 may include third to thirteenth buffer switches.

In this case, each of the buffer parallel switches 362 may be turned on or off based on the inverted data resolution control signal IDS output from the data resolution control signal output device 310. That is, the same inverted data resolution control signal IDS may be supplied to the buffer parallel switches 362 included in the data buffer device 360 and the data parallel switches 332 included in the latch selection device 330. Accordingly, the buffer parallel switches 362 and the data parallel switches 332 may be turned on or off in the same form.

Each of the data buffers 361 may be driven based on the data buffer control signal PD which is the same as the inverted data resolution control signal IDS and may output a data voltage, transferred from the digital-to-analog conversion device 350, to a corresponding data line. That is, the data buffers 361 may output data voltages to the data lines on the basis of the data buffer control signal PD, or may not output the data voltages to the data lines on the basis of the data buffer control signal PD.

To this end, a first data buffer control signal PD1 may be supplied to a first data buffer provided at a leftmost portion among the data buffers 361 illustrated in FIG. 7(*a*), and second to twelfth data buffer control signals PD2 to PD12 may be supplied to data buffers provided at a rightmost portion among the data buffers 361.

A data voltage supplied through one data buffer 361 may be output to only one data line, or may be output to at least two data lines through at least one buffer parallel switch 362.

For example, in a case where the data buffer control signals PD and the inverted data resolution control signals IDS are configured as illustrated in FIG. 7 (*a*), a first data buffer may output a first data voltage Vdata1 to a corresponding data line on the basis of the first data buffer control signal PD1 having an off value. In this case, the second to fourth buffer parallel switches may be turned on based on the second to fourth inverted data resolution control signals IDS2 to IDS4 having an on value, and thus, the same data voltage may be output to first to fourth data lines DL1 to DL4. In the following description, four data lines to which the same data voltage is output may be referred to as a first data line group D_Group1. A low resolution may be realized by the first data line group D_Group1.

Moreover, in a case where the data buffer control signals PD and the inverted data resolution control signals IDS are configured as illustrated in FIG. 7(*a*), a fifth data buffer may output a fifth data voltage Vdata5 to a corresponding data line on the basis of the fifth data buffer control signal PD5 having an off value. In this case, the sixth buffer parallel switch may be turned on based on a sixth inverted data resolution control signal IDS6 having an on value, and thus, the same data voltage may be output to fifth and sixth data lines DL5 and DL6. In the following description, two data lines to which the same data voltage is output may be referred to as a second data line group D_Group2. A middle resolution may be realized by the second data line group D_Group2. In this case, the same data voltage may be output to seventh and eighth data lines DL7 and DL8. Accordingly, the seventh and eighth data lines DL7 and DL8 may be referred to as a second data line group D_Group2.

Moreover, in a case where the data buffer control signals PD and the inverted data resolution control signals IDS are configured as illustrated in FIG. 7(*a*), ninth to twelfth data buffers may output ninth to twelfth data voltages Vdata9 to Vdata12 to ninth to twelfth data lines DL9 to DL12 on the basis of ninth to twelfth data buffer control signals PD9 to PD12 having an off value. In this case, ninth to twelfth buffer parallel switches may be turned off based on ninth to twelfth inverted data resolution control signals IDS9 to IDS12 having an off value. Therefore, different ninth to twelfth data voltages Vdata9 to Vdata12 may be output to the ninth to twelfth data lines DL9 to DL12. In the following description, data lines to which different data voltages are output may be referred to as a third data line group D_Group3. A high resolution may be realized by the third data line group D_Group3.

As described above, according to the present disclosure, even when only seven data buffers 361 (for example, the first data buffer, the fifth data buffer, the seventh data buffer, and the ninth to twelfth data buffers) among twelve data buffers 361 are driven, data voltages may be output to twelve data lines DL1 to DL12. Accordingly, according to the present disclosure, the power consumption of the data buffer device 360 may decrease, and thus, the power consumption of the display apparatus may be reduced.

Figure 8A:
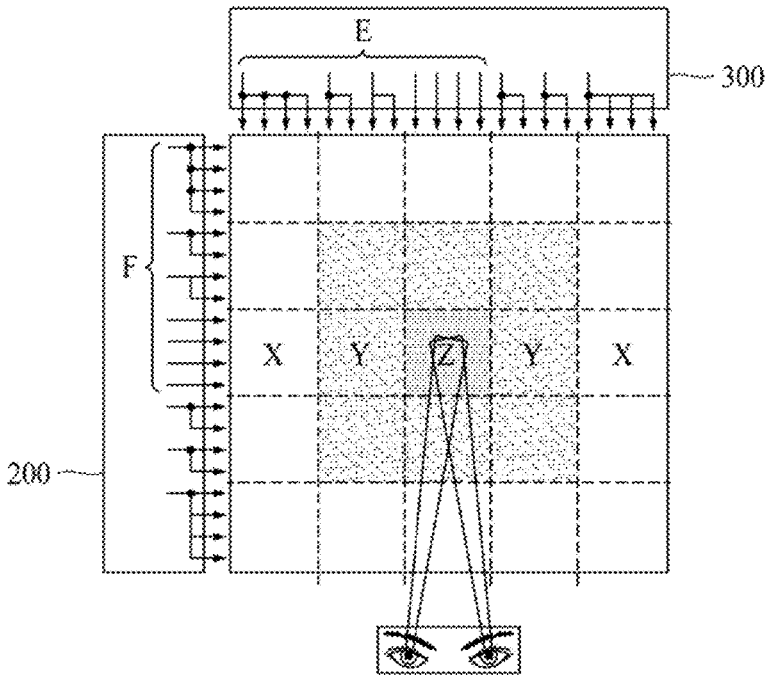
FIGS. 8A to 8C are exemplary diagrams for describing a method of realizing a high resolution, a middle resolution, and a low resolution by using a display apparatus according to the present disclosure.
Figure 8B:
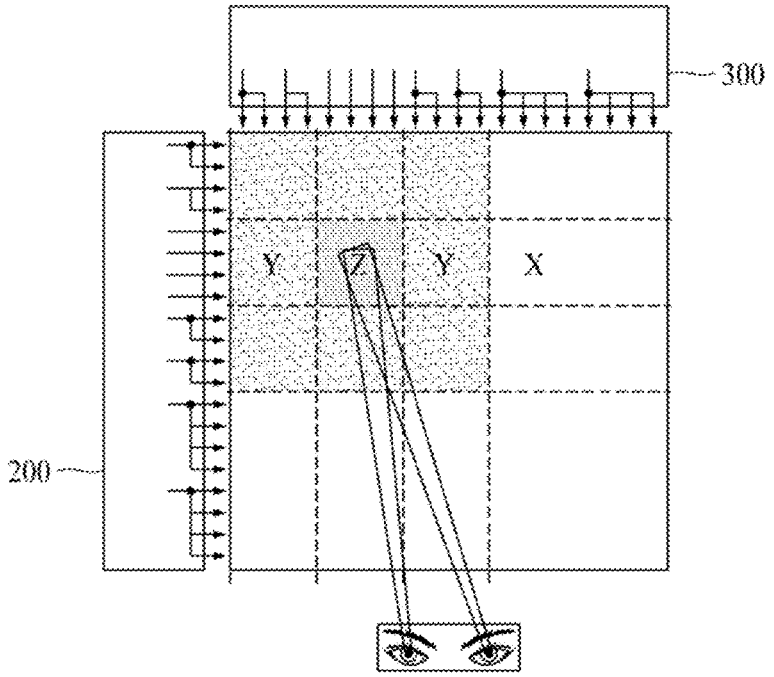
Figure 8C:
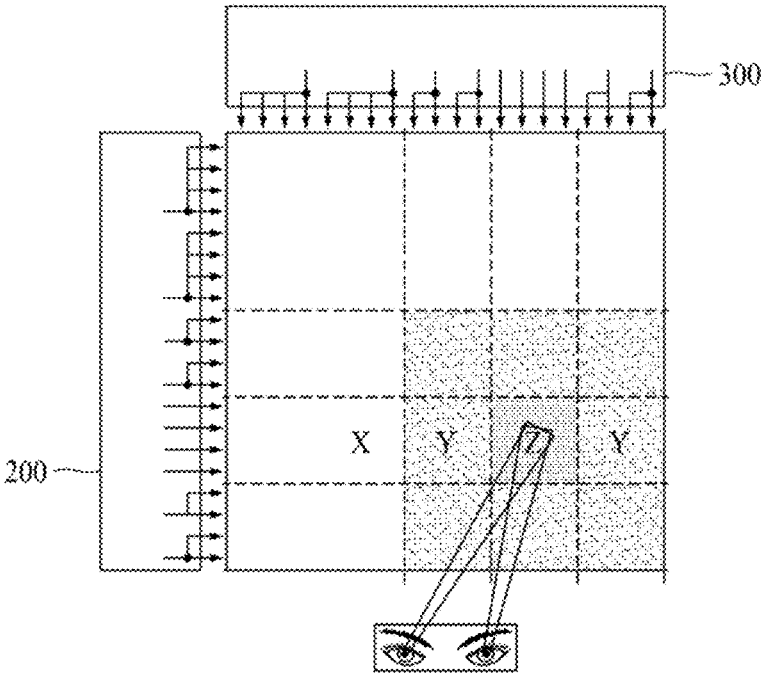

FIGS. 8A to 8C are exemplary diagrams for describing a method of realizing a high resolution, a middle resolution, and a low resolution by using a display apparatus according to the present disclosure. In FIGS. 8A to 8C, arrows illustrated in a gate driver 200 may denote gate pulses which are output to gate lines, and arrows illustrated in a data driver 300 may denote data voltages which are output to data lines. That is, the same gate pulses may be output to four gate lines, the same gate pulses may be output to two gate lines, and different gate pulses may be output to respective gate lines. Also, the same data voltages may be output to four data lines, the same data voltages may be output to two data lines, and different data voltages may be output to respective data lines.

As described above, the display apparatus according to the present disclosure may be applied to VR devices, and a VR device may be manufactured in a goggle form which is worn in an eye region of a user.

In this case, the user may see a VR screen displayed by the VR device with eyes, and a focus of eyes of the user may move along the VR screen.

In VR devices, in order to increase the power of attention, as illustrated in FIGS. 8A to 8C, positions of a low resolution region X, a middle resolution region Y, and a high resolution region Z may be changed.

For example, a focus position of the eyes of the user may be determined by a sensor included in the VR device, and when a focus of the eyes of the user faces a center portion of a display panel as illustrated in FIG. 8A, the display apparatus according to the present disclosure may display the center portion of the display panel as the high resolution region Z, display an outer portion of the high resolution region Z as the middle resolution region Y, and display an outer portion of the middle resolution region Y as the low resolution region X.

Moreover, when the focus of the eyes of the user faces a left upper end portion of the display panel as illustrated in FIG. 8B, the display apparatus according to the present disclosure may display the left upper end portion of the display panel as the high resolution region Z, and when the focus of the eyes of the user faces a right lower end portion of the display panel as illustrated in FIG. 8C, the display apparatus according to the present disclosure may display the right lower end portion of the display panel as the high resolution region Z.

To this end, as illustrated in FIGS. 8A to 8C, the gate driver 200 according to the present disclosure may output the same gate pulse to four adjacent gate lines of gate lines included in the low resolution region X, output the same gate pulse to two adjacent gate lines of gate lines included in the middle resolution region Y, and output different gate pulses to gate lines included in the high resolution region Z.

Moreover, for example, as illustrated in FIGS. 8A to 8C, the data driver 300 according to the present disclosure may output the same data voltage to four adjacent data lines of data lines included in the low resolution region X, output the same data voltage to two adjacent data lines of data lines included in the middle resolution region Y, and output different data voltages to data lines included in the high resolution region Z.

In this case, for example, as illustrated in FIG. 8A, gate lines included in the high resolution region Z may also be included in the low resolution region X, and thus, different gate pulses may be respectively supplied to the gate lines which are included in the high resolution region Z and the low resolution region X. However, the same data voltage may be supplied to four data lines included in the low resolution region X. Accordingly, a low resolution may be realized in the low resolution region X.

Moreover, different gate pulses may be respectively supplied to the gate lines which are included in the high resolution region Z and the middle resolution region Y. However, as illustrated in FIG. 8A, the same data voltage may be supplied to two data lines included in the middle resolution region Y. Accordingly, a middle resolution may be realized in the middle resolution region Y.

Moreover, the above description may be identically applied to description based on data lines.

Hereinafter, a driving method of a display apparatus according to the present disclosure will be described with reference to FIGS. 1 to 12. In the following description, a display apparatus where data voltages and gate pulses are output in a form illustrated in FIG. 8A will be described as an example of the present disclosure. Hereinafter, particularly, the present disclosure will be described by using twelve data voltages E output from a leftmost portion of the data driver 300 illustrated in FIG. 8A and twelve gate pulses F output from an uppermost portion of the gate driver 200 illustrated in FIG. 8A.

Figure 10:
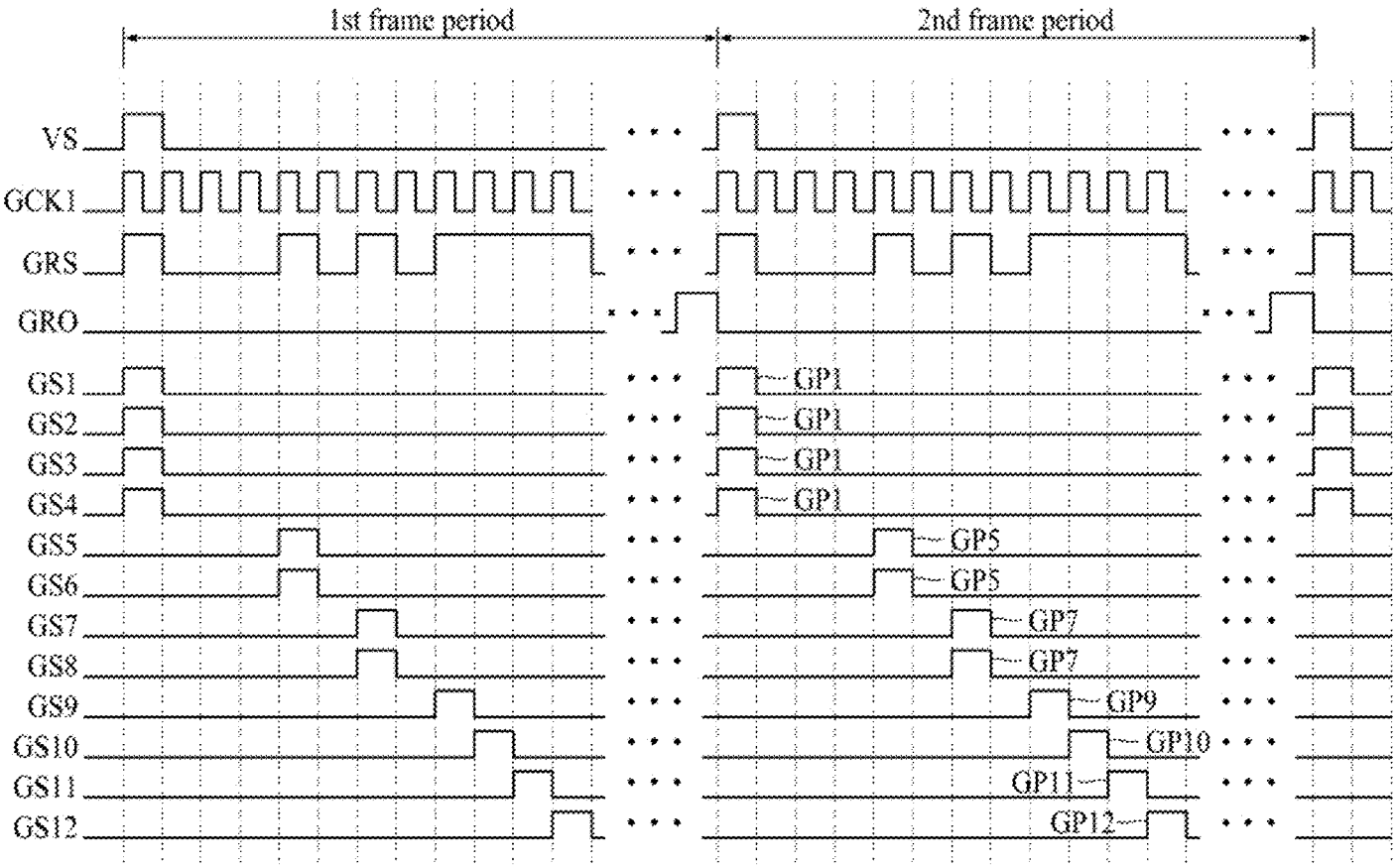
FIG. 10 is a timing diagram showing signals for driving the gate driver illustrated in FIG. 9.
Figure 11:
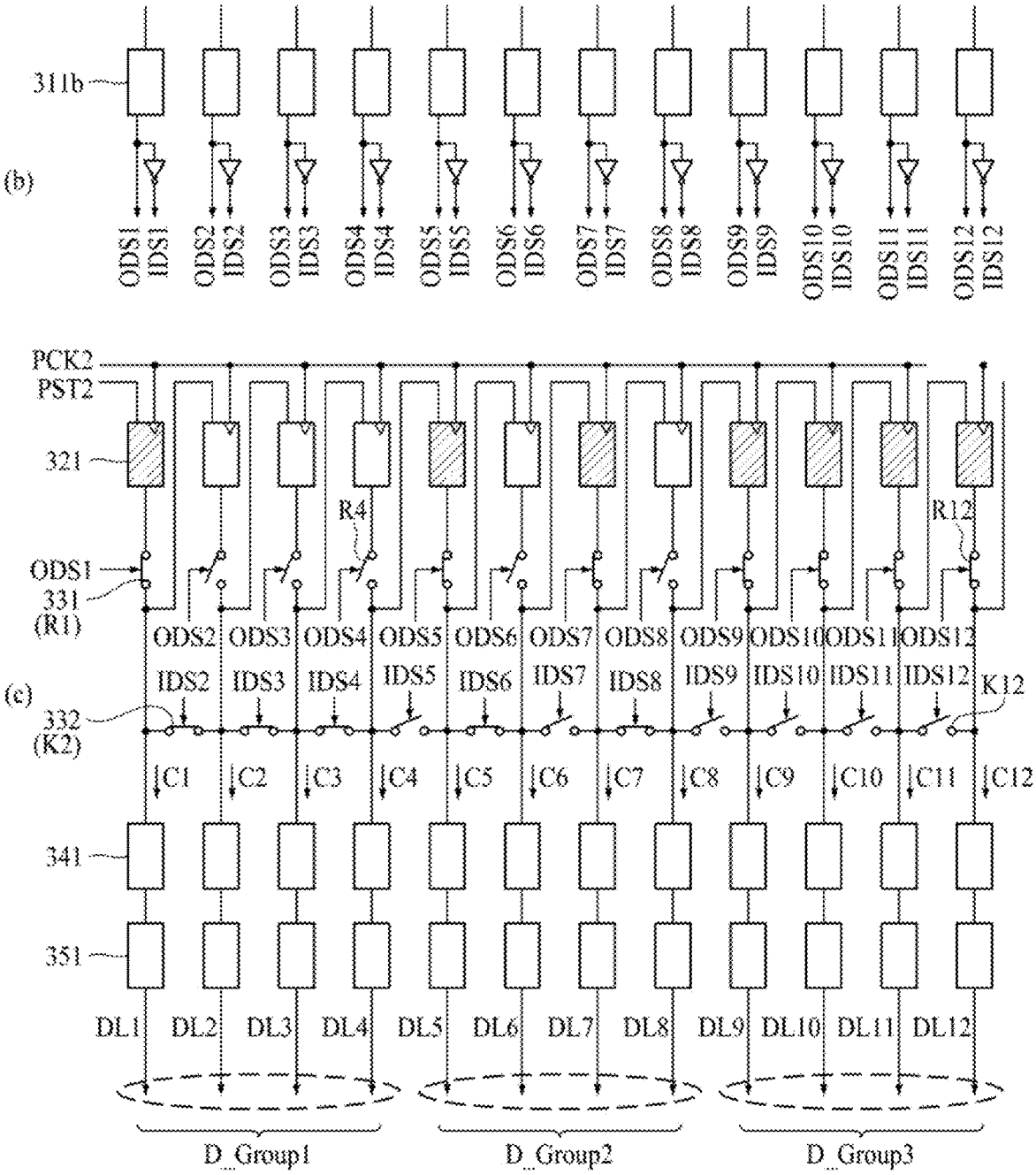
FIG. 11 is an exemplary diagram for describing a method of realizing a high resolution, a middle resolution, and a low resolution by using a data driver according to the present disclosure.
Figure 12:
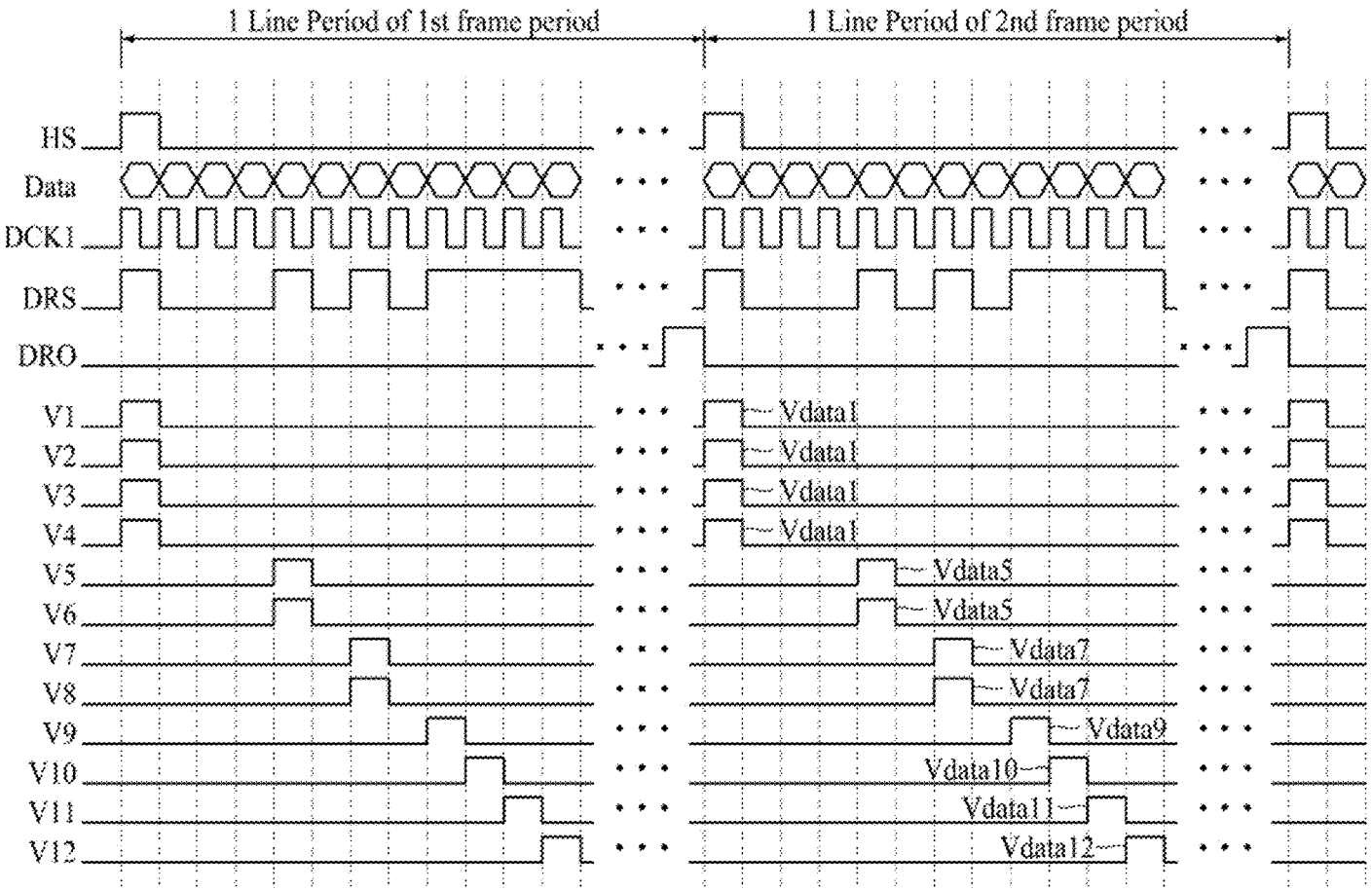
FIG. 12 is a timing diagram showing signals for driving the data driver illustrated in FIG. 11.

FIG. 9 is an exemplary diagram for describing a method of realizing a high resolution, a middle resolution, and a low resolution by using a gate driver according to the present disclosure, FIG. 10 is a timing diagram showing signals for driving the gate driver illustrated in FIG. 9, FIG. 11 is an exemplary diagram for describing a method of realizing a high resolution, a middle resolution, and a low resolution by using a data driver according to the present disclosure, and FIG. 12 is a timing diagram showing signals for driving the data driver illustrated in FIG. 11. In FIG. 10, reference numeral "VS" may refer to a signal which defines a first frame period and a second frame period, and in FIG. 12, reference numeral "HS" may refer to a signal which defines a one-line period of the first frame period and a one-line period of the second frame period. During a one-line period, data voltages may be simultaneously output to all data lines. In the following description, descriptions which are the same as or similar to descriptions given above with reference to FIGS. 1 to 8C are omitted or will be briefly given.

First, in a first frame period (1st frame period), original gate resolution control signals OGS and inverted gate resolution control signals IGS having values illustrated in FIG. 9 (*a*) may be stored in a gate resolution control signal output device 210 on the basis of a method described above with reference to FIGS. 4 and 5.

That is, as illustrated in FIG. 10, in the first frame period, a plurality of gate resolution signal registers 211*a* may be sequentially driven by a gate resolution signal control clock GCK1, and thus, gate resolution signals GRS (i.e., original gate resolution control signals OGS illustrated in FIG. 9(*a*)) may be stored in a plurality of gate resolution signal storages 211*b*.

Moreover, in the first frame period, original data resolution control signals ODS and inverted data resolution control signals IDS having values illustrated in FIG. 11(*a*) may be stored in a data resolution control signal output device 310 on the basis of a method described above with reference to FIG. 6.

That is, in the first frame period, a plurality of data resolution signal registers 311*a* may be sequentially driven by a data resolution signal control clock DCK1, and thus, data resolution signals DRS (i.e., original data resolution control signals ODS illustrated in FIG. 11(*a*)) may be stored in a plurality of data resolution signal storages 311*b*.

Subsequently, immediately before a second frame period (2nd frame period) starts, a gate resolution output signal GRO having a high value may be supplied to the gate resolution control signal output device 210.

Therefore, in the gate resolution control signal output device 210, the original gate resolution control signals OGS and the inverted gate resolution control signals IGS having the values illustrated in FIG. 9(*a*) may be simultaneously output to a gate line selection device 230.

Moreover, immediately before the second frame period starts, as illustrated in FIG. 12, the data resolution output signal DRO having a high value may be supplied to the data resolution control signal output device 310.

Therefore, in the data resolution control signal output device 310, the original data resolution control signals ODS and the inverted data resolution control signals IDS having values illustrated in FIG. 11(*a*) may be simultaneously output to a latch selection device 330.

Subsequently, when the original gate resolution control signals OGS and the inverted gate resolution control signals IGS having the values illustrated in FIG. 9(*a*) may be simultaneously output to a gate line selection device 230 after the second frame period starts, as illustrated in FIG. 9(*c*), a first gate serial switch S1 may be turned on based on a first original gate resolution control signal OGS1 having an on value, second to fourth gate serial switches S2 to S4 may be turned off based on second to fourth original gate resolution control signals OGS2 to OGS4 having an off value, and second to fourth gate parallel switches P2 to P4 may be turned on based on second to fourth inverted gate resolution control signals IGS2 to IGS4 having an on value.

Therefore, as illustrated in FIGS. 9(*c*) and 10, a first gate pulse GP1 may be output to first to fourth gate lines GL1 to GL4 in the second frame period (2nd frame period). Here, the first gate pulse GP1 may denote a gate pulse which is generated in a first gate stage. Thus, the first gate pulse GP1 is simultaneously supplied to the first to fourth gate lines GL1 to GL4. In the following description, four gate lines (for example first to fourth gate lines GL1 to GL4) to which the same gate pulse is output may be referred to as a first gate line group G_Group1. A low resolution may be realized by the first gate line group G_Group1. Also, in the following description, two gate lines to which the same gate pulse is output (for example, fifth and sixth gate lines GL5, GL6, and seventh and eight gate lines GL7, GL8, respectively) may be referred to as a second gate line group G_Group2. A middle resolution may be realized by the second gate line group G_Group2. In the following description, gate lines to which different gate pulses are output (for example gate lines GL9 to GL12) may be referred to as a third gate line group D_Group3. A high resolution may be realized by the third gate line group D_Group3.

Moreover, when the original data resolution control signals ODS and the inverted data resolution control signals IDS having the values illustrated in FIG. 11(*a*) are output to a data line selection device 330 after the second frame period starts, as illustrated in FIG. 11(*c*), a first data serial switch R1 may be turned on based on a first original data resolution control signal ODS1 having an on value, second to fourth data serial switches R2 to R4 may be turned off based on second to fourth original data resolution control signals ODS2 to ODS4 having an off value, and second to fourth data parallel switches K2 to K4 may be turned on based on second to fourth inverted data resolution control signals IDS2 to IDS4 having an on value.

Therefore, as illustrated in FIGS. 11(*c*) and 12, a first data voltage Vdata1 may be output to first to fourth data lines DL1 to DL4 during a one-line period of the second frame period (2nd frame period). Here, the first data voltage Vdata1 may denote a data voltage which is generated by first to fourth conversion units. In FIGS. 12, V1 to V12 may refer to data line voltages which are supplied to data lines, and the data line voltages may be data voltages Vdata. As the first gate pulse GP1 is output to the first to fourth gate lines GL1 to GL4 and the first data voltage Vdata1 is output to the first to fourth data lines DL1 to DL4, as illustrated in FIG. 8A, the low resolution region X may be formed in an area where the first to fourth gate lines GL1 to GL4 intersect with the first to fourth data lines DL1 to DL4.

Subsequently, when the original gate resolution control signals OGS and the inverted gate resolution control signals IGS having the values illustrated in FIG. 9(*a*) may be simultaneously output to the gate line selection device 230 after the second frame period starts, as illustrated in FIG. 9(*c*), fifth and seventh gate serial switches S5 and S7 may be turned on based on fifth and seventh original gate resolution control signals OGS5 and OSG7 having an on value, sixth and eighth gate serial switches S6 and S8 may be turned off based on sixth and eighth original gate resolution control signals OGS6 and OGS8 having an off value, fifth and seventh gate parallel switches P5 and P7 may be turned off based on fifth and seventh inverted gate resolution control signals IGS5 and IGS7 having an off value, and sixth and eighth gate parallel switches P6 and P8 may be turned on based on sixth and eighth inverted gate resolution control signals IGS6 and IGS8 having an on value.

Therefore, as illustrated in FIGS. 9(*c*) and 10, a fifth gate pulse GP5 may be output to fifth and sixth gate lines GL5 and GL6, and a seventh gate pulse GP7 may be output to seventh and eighth gate lines GL7 and GL8. Here, the fifth gate pulse GP5 may denote a gate pulse which is generated in a fifth gate stage, and the seventh gate pulse GP7 may denote a gate pulse which is generated in a seventh gate stage.

Moreover, when the original data resolution control signals ODS and the inverted data resolution control signals IDS having the values illustrated in FIG. 11(*a*) are output to a latch selection device 330 after the second frame period starts, as illustrated in FIG. 11(*c*), fifth and seventh data serial switches R5 and R7 may be turned on based on fifth and seventh original data resolution control signals ODS5 and ODS7 having an on value, sixth and eighth data serial switches R6 and R8 may be turned off based on sixth and eighth original data resolution control signals ODS6 and ODS8 having an off value, fifth and seventh data parallel switches K5 and K7 may be turned off based on fifth and seventh inverted data resolution control signals IDS5 and IDS7 having an off value, and sixth and eighth data parallel switches K6 and K8 may be turned on based on sixth and eighth inverted data resolution control signals IDS6 and IDS8 having an on value.

Therefore, as illustrated in FIGS. 11(*c*) and 12, a fifth data voltage Vdata5 may be output to fifth and sixth data lines DL5 and DL6, and a seventh data voltage Vdata7 may be output to seventh and eighth data lines DL7 and DL8. Here, the fifth data voltage Vdata5 may denote a data voltage which is generated by fifth and sixth conversion units, and the seventh data voltage Vdata7 may denote a data voltage which is generated by seventh and eighth conversion units.

As the fifth gate pulse GP5 is output to the fifth and sixth gate lines GL5 and GL6, the fifth data voltage Vdata5 is output to the fifth and sixth data lines DL5 and DL6, the seventh gate pulse GP7 is output to the seventh and eighth gate lines GL7 and GL8, and the seventh data voltage Vdata7 is output to the seventh and eighth data lines DL7 and DL8, as illustrated in FIG. 8A, the middle resolution region Y may be formed in an area where the fifth to eighth gate lines GL5 to GL8 intersect with the fifth to eighth data lines DL5 to DL8.

Finally, when the original gate resolution control signals OGS and the inverted gate resolution control signals IGS having the values illustrated in FIG. 9(*a*) may be simultaneously output to the gate line selection device 230 after the second frame period starts, as illustrated in FIG. 9(*c*), ninth to twelfth gate serial switches S9 to S12 may be turned on based on ninth to twelfth original gate resolution control signals OGS9 to OSG12 having an on value, and ninth to twelfth gate parallel switches P9 to P12 may be turned off based on ninth to twelfth inverted gate resolution control signals IGS9 to IGS12 having an off value.

Therefore, as illustrated in FIGS. 9(*c*) and 10, ninth to twelfth gate pulses GP9 to GP12 may be output to ninth to twelfth gate lines GL9 to GL12. Here, the ninth gate pulse GP9 may denote a gate pulse which is generated in a ninth gate stage, the tenth gate pulse GP10 may denote a gate pulse which is generated in a tenth gate stage, the eleventh gate pulse GP11 may denote a gate pulse which is generated in an eleventh gate stage, and the twelfth gate pulse GP12 may denote a gate pulse which is generated in a twelfth gate stage.

Moreover, when the original data resolution control signals ODS and the inverted data resolution control signals IDS having the values illustrated in FIG. 11(*a*) are output to the latch selection device 330 after the second frame period starts, as illustrated in FIG. 11(*c*), ninth to twelfth data serial switches R9 to R12 may be turned on based on ninth to twelfth original data resolution control signals ODS9 to ODS12 having an on value, and ninth to twelfth data parallel switches K9 to K12 may be turned off based on ninth to twelfth inverted data resolution control signals IDS9 to IDS12 having an off value.

Therefore, as illustrated in FIGS. 11(*c*) and 12, ninth to twelfth data voltages Vdata9 to Vdata12 may be output to ninth to twelfth data lines DL9 to DL12. Here, the ninth data voltage Vdata9 may denote a data voltage which is generated by a ninth conversion unit, the tenth data voltage Vdata10 may denote a data voltage which is generated by a tenth conversion unit, the eleventh data voltage Vdata11 may denote a data voltage which is generated by an eleventh conversion unit, and the twelfth data voltage Vdata12 may denote a data voltage which is generated by a twelfth conversion unit.

As ninth to twelfth gate pulses GP9 to GP12 are output to the ninth to twelfth gate lines GL9 to GL12 and ninth to twelfth data voltages Vdata9 to Vdata12 are output to the ninth to twelfth data lines DL9 to DL12, as illustrated in FIG. 8A, the high resolution region Z may be formed in an area where the ninth to twelfth gate pulses GP9 to GP12 intersect with the ninth to twelfth gate lines GL9 to GL12.

As described above, according to the present disclosure, the low resolution region X, the middle resolution region Y, and the high resolution region Z may be variously changed based on a focus position of eyes of a user.

According to the embodiments of the present disclosure, as a focus position of eyes of a user are changed, a resolution of each region of a display panel may be changed. Accordingly, the user may enjoy sharper VR.

Moreover, according to the embodiments of the present disclosure, the number of gate pulses generated by a gate driver may decrease, and the number of data voltages generated by a data driver may be reduced. Accordingly, the power consumption of the gate driver and the data driver may be reduced, and thus, the power consumption of a display apparatus may decrease.

The above-described feature, structure, and effect of the present disclosure are included in at least one embodiment of the present disclosure, but are not limited to only one embodiment. Furthermore, the feature, structure, and effect described in at least one embodiment of the present disclosure may be implemented through combination or modification of other embodiments by those skilled in the art. Therefore, content associated with the combination and modification should be construed as being within the scope of the present disclosure.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A gate driver comprising:

a gate resolution control signal output device outputting gate resolution control signals;

a gate pulse generating device generating gate pulses which are to be output to a plurality of gate lines; and a gate line selection device selecting gate lines, to which the gate pulses output from the gate pulse generating device are to be transferred, based on the gate resolution control signals, wherein:

the gate pulse generating device comprises a plurality of gate stages generating the gate pulses, the gate line selection device comprises:

a plurality of gate serial switches; and a plurality of gate parallel switches, the plurality of gate serial switches respectively connect the plurality of gate stages to the plurality of gate lines, each of the plurality of gate parallel switches connects two adjacent gate lines, each of the plurality of gate serial switches is turned on or off based on an original gate resolution control signal output from the gate resolution control signal output device, each of the plurality of gate parallel switches is turned on or off based on an inverted gate resolution control signal output from the gate resolution control signal output device, and the inverted gate resolution control signal is a signal obtained by inverting the original gate resolution control signal.

2. The gate driver of claim 1, wherein the gate resolution control signal output device comprises:

a gate resolution signal storage unit storing gate resolution signals corresponding to the gate lines; and a gate resolution control signal output unit transferring the gate resolution control signals, generated based on the gate resolution signals, to the gate line selection device.

3. The gate driver of claim 2, wherein the gate resolution signal storage unit comprises:

a plurality of gate resolution signal storages storing gate resolution signals corresponding to the gate lines and simultaneously outputting the gate resolution signals; and a plurality of gate resolution signal registers sequentially driving the plurality of gate resolution signal storages to allow the gate resolution signals to be stored in the plurality of gate resolution signal storages.

4. The gate driver of claim 2, wherein the gate resolution control signal output unit comprises:

a plurality of original gate resolution control signal lines transferring original gate resolution control signals, corresponding to the gate resolution signals output from the gate resolution signal storage unit, to the gate line selection device;

a plurality of gate inverters inverting the original gate resolution control signals; and a plurality of inversion gate resolution control signal lines transferring inverted gate resolution control signals, output from the plurality of gate inverters, to the gate line selection device.

5. The gate driver of claim 1, wherein the gate resolution control signals correspond to a focus of eyes of a user.

6. The gate driver of claim 1, wherein, when an $m^{th}$ gate serial switch of the plurality of gate serial switches is turned on, an $m^{th}$ gate pulse transferred from an $m^{th}$ gate stage to the $m^{th}$ gate serial switch is output to an $m^{th}$ gate line connected to the $m^{th}$ gate serial switch, and the $m^{th}$ gate pulse is output to at least one gate line, which is adjacent to the $m^{th}$ gate line, through at least one gate parallel switch connected to the $m^{th}$ gate line.

7. The gate driver of claim 6, wherein the $m^{th}$ gate pulse is transferred to one of gate stages, provided subsequent to the $m^{th}$ gate stage, through the at least one gate parallel switch connected to the $m^{th}$ gate line.

8. A data driver comprising:

a data resolution control signal output device outputting data resolution control signals;

a latch device storing pieces of image data;

a shift register device generating data storage control signals which allow a plurality of latches included in the latch device to store the pieces of image data;

a latch selection device selecting latches, to which the data storage control signals output from the shift register device are to be transferred, based on the data resolution control signals;

a digital-to-analog conversion device generating data voltages which are to be output to a plurality of data lines, based on the pieces of image data transferred from the latch device; and a data buffer device simultaneously outputting the data voltages to the plurality of data lines, wherein the data resolution control signal output device comprises:

a data resolution signal storage unit storing data resolution signals corresponding to the plurality of data lines; and a data resolution control signal output unit transferring the data resolution control signals, generated based on the data resolution signals, to the latch selection device, the shift register device comprises a plurality of data stages generating the data storage control signals, the latch selection device comprises:

a plurality of data serial switches; and a plurality of data parallel switches, the plurality of data serial switches respectively connect the plurality of data stages to the plurality of latches, and each of the plurality of data parallel switches connects two adjacent auxiliary data lines of among a plurality of auxiliary data lines which respectively connect the plurality of data serial switches to the plurality of latches in one-to-one relationship.

9. The data driver of claim 8, wherein the data resolution control signals correspond to a focus of eyes of a user.

10. The data driver of claim 8, wherein the data resolution signal storage unit comprises:

a plurality of data resolution signal storages storing data resolution signals corresponding to the plurality of data lines and simultaneously outputting the data resolution signals; and a plurality of data resolution signal registers sequentially driving the plurality of data resolution signal storages to allow the data resolution signals to be stored in the plurality of data resolution signal storages.

11. The data driver of claim 8, wherein the data resolution control signal output unit comprises:

a plurality of original data resolution control signal lines transferring original data resolution control signals, corresponding to the data resolution signals output from the data resolution signal storage unit, to the latch selection device;

a plurality of data inverters inverting the original data resolution control signals; and a plurality of inversion data resolution control signal lines transferring inverted data resolution control signals, output from the plurality of data inverters, to the latch selection device.

12. The data driver of claim 8, wherein each of the plurality of data serial switches is turned on or off based on an original data resolution control signal output from the data resolution control signal output device, each of the plurality of data parallel switches is turned on or off based on an inverted data resolution control signal output from the data resolution control signal output device, and the inverted data resolution control signal is a signal obtained by inverting the original data resolution control signal.

13. The data driver of claim 12, wherein, when an $m^{th}$ data serial switch among the plurality of data serial switches is turned on, an $m^{th}$ data storage control signal transferred from an $m^{th}$ data stage to the $m^{th}$ data serial switch is output to an $m^{th}$ latch through an $m^{th}$ auxiliary data line connected to the $m^{th}$ data serial switch, and the $m^{th}$ data storage control signal is output to at least one auxiliary data line, which is adjacent to the $m^{th}$ auxiliary data line, through at least one data parallel switch connected to the $m^{th}$ auxiliary data line.

14. The data driver of claim 13, wherein the $m^{th}$ data storage control signal is transferred to one of latches, provided subsequent to the $m^{th}$ latch, through the at least one data parallel switch connected to the $m^{th}$ auxiliary data line.

15. The data driver of claim 8, wherein the data buffer device comprises:

a plurality of data buffers respectively connected to a plurality of conversion units configuring the digital-to-analog conversion device; and a plurality of buffer parallel switches, and each of the plurality of buffer parallel switches connects two adjacent data lines.

16. The data driver of claim 15, wherein each of the plurality of buffer parallel switches is turned on or off based on an inverted data resolution control signal output from the data resolution control signal output device, each of the plurality of data buffers is driven based on a data buffer control signal and outputs a data voltage, transferred from the digital-to-analog conversion device, to a corresponding data line, and a data voltage supplied through one data buffer is output to one data line, or is output to at least two data lines through at least one buffer parallel switch.

17. A display apparatus comprising:

a display panel displaying an image;

a data driver supplying data voltages to a plurality of data lines included in the display panel;

a gate driver supplying gate pulses to a plurality of gate lines included in the display panel; and a controller controlling the data driver and the gate driver, wherein the gate driver comprises:

a gate resolution control signal output device outputting gate resolution control signals corresponding to a focus of eyes of a user;

a gate pulse generating device generating the gate pulses which are to be output to the plurality of gate lines; and a gate line selection device selecting gate lines, to which the gate pulses output from the gate pulse generating device are to be transferred, based on the gate resolution control signals, and wherein:

the gate pulse generating device comprises a plurality of gate stages generating the gate pulses, the gate line selection device comprises:

a plurality of gate serial switches; and a plurality of gate parallel switches, the plurality of gate serial switches respectively connect the plurality of gate stages to the plurality of gate lines, each of the plurality of gate parallel switches connects two adjacent gate lines, each of the plurality of gate serial switches is turned on or off based on an original gate resolution control signal output from the gate resolution control signal output device, each of the plurality of gate parallel switches is turned on or off based on an inverted gate resolution control signal output from the gate resolution control signal output device, and the inverted gate resolution control signal is a signal obtained by inverting the original gate resolution control signal.

* * * * *